US009289731B2

(12) United States Patent
Tatera

(10) Patent No.: US 9,289,731 B2
(45) **Date of Patent: *Mar. 22, 2016**

(54) CARBONATION DEVICE

(71) Applicant: PAT'S BACKCOUNTRY BEVERAGES INC., Golden, CO (US)

(72) Inventor: Patrick J. Tatera, Wheat Ridge, CO (US)

( * ) Notice: Subject to any disclaimer, the term of this patent is extended or adjusted under 35 U.S.C. 154(b) by 191 days.

This patent is subject to a terminal disclaimer.

(21) Appl. No.: 14/083,329

(22) Filed: Nov. 18, 2013

(65) Prior Publication Data

US 2014/0070432 A1 Mar. 13, 2014

Related U.S. Application Data

(63) Continuation-in-part of application No. 12/978,386, filed on Dec. 23, 2010, now Pat. No. 8,641,016, and a continuation-in-part of application No. 12/591,407, filed on Nov. 18, 2009, now Pat. No. 8,267,007.

(51) Int. Cl.
*B01F 3/04* (2006.01)
*B01F 15/02* (2006.01)

(52) U.S. Cl.
CPC ..... *B01F 3/04801* (2013.01); *B01F 15/0224* (2013.01); *B01F 15/0201* (2013.01)

(58) Field of Classification Search
CPC ..... B01F 3/04801; B01F 15/0201; B01F 15/0224
USPC ..... 261/62, 65, 66, 71, 74, DIG. 7; 99/323.1, 323.2
See application file for complete search history.

(56) References Cited

U.S. PATENT DOCUMENTS

| | | | |
|---|---|---|---|
| 437,318 | A | 9/1890 | Thackeray |
| 2,073,273 | A | 3/1937 | Wetstein |
| 2,600,901 | A | 6/1952 | Meldau |
| 3,851,797 | A | 12/1974 | Jacobs |
| 4,251,473 | A | 2/1981 | Gilbey |
| 4,316,409 | A | 2/1982 | Adams et al. |
| 4,458,584 | A | 7/1984 | Annese et al. |
| 4,514,994 | A | 5/1985 | Mabb |
| 4,679,602 | A | 7/1987 | Hollis et al. |

(Continued)

FOREIGN PATENT DOCUMENTS

GB 2 137 894 A 10/1984

*Primary Examiner* — Charles Bushey
*Assistant Examiner* — Scott Bushey
(74) *Attorney, Agent, or Firm* — Richard C. Litman

(57) ABSTRACT

The carbonation device includes a cap system selectively mounted to the mouth of a liquid container. The cap system includes a cap, a syringe piston reciprocable within the cap, an actuating mechanism for reciprocating the syringe piston, and a reaction vessel selectively attached to the bottom of the cap. The syringe piston includes a storage area to be filled with reactant liquid (water) by repeated activation of the actuating mechanism. The water from the charged syringe piston discharges into the reaction vessel that has been filled with a preselected amount of reactants to initiate the carbonation reaction. In various embodiments, the carbonation device includes a rotatable control ring to selectively puncture a $CO_2$ cartridge inside the reaction vessel or introduce water into the reaction vessel to initiate carbonation reaction. In various embodiments, the $CO_2$ flows from the reaction vessel into the container to carbonate the liquid or beverage contained therein.

19 Claims, 17 Drawing Sheets

(56) References Cited

U.S. PATENT DOCUMENTS

| | | | | |
|---|---|---|---|---|
| 4,867,209 | A * | 9/1989 | Santoiemmo | 141/19 |
| 5,031,799 | A | 7/1991 | Owen | |
| 5,182,084 | A | 1/1993 | Plester | |
| 5,460,846 | A | 10/1995 | Stumphauzer et al. | |
| 5,549,037 | A | 8/1996 | Stumphauzer et al. | |
| 5,725,896 | A | 3/1998 | Banks | |
| 5,836,364 | A | 11/1998 | Burton | |
| 6,017,021 | A * | 1/2000 | Yiu | 261/64.1 |
| 7,975,988 | B2 * | 7/2011 | Thomson et al. | 261/65 |
| 8,267,007 | B2 | 9/2012 | Tatera | |
| D673,423 | S | 1/2013 | Lane et al. | |
| 8,455,032 | B2 * | 6/2013 | Gormley et al. | 426/477 |
| 8,479,645 | B2 * | 7/2013 | Tatera | 99/323.2 |
| 8,641,016 | B2 * | 2/2014 | Tatera | 261/62 |
| 2011/0115103 | A1 | 5/2011 | Tatera | |

* cited by examiner

CARBONATION DEVICE

CROSS REFERENCE TO RELATED APPLICATIONS

This is a continuation-in-part of my prior application Ser. No. 12/978,386, filed Dec. 23, 2010, now U.S. Pat. No. 8,641,016, which in turn is a continuation-in-part of my prior application Ser. No. 12/591,407, filed Nov. 18, 2009, now U.S. Pat. No. 8,267,007, which are hereby incorporated by reference in their entirety.

BACKGROUND OF THE INVENTION

1. Field of the Invention

The present invention relates to beverage enhancers, and more specifically to a carbonation device for carbonating beverages, particularly home-brew beer, in a relatively short amount of time.

2. Description of the Related Art

One of the basic necessities to any outdoor activity is potable liquid. It is basic to survival and allows the outdoorsman, e.g. backpackers, hunters, hikers and campers, to keep the body hydrated during the physical activity. If the outdoorsman desires carbonated beverages, the outdoorsman is relegated to toting around bottles or cans of pre-carbonated beverages that can add considerable weight and bulk to his or her pack. A majority of the weight and volume is attributed to the water component in the beverages.

A solution for the drawbacks of the above would be to carry a beverage concentrate to which a user can add purified water for a refreshing drink. However, this solution still lacks the effervescent sensation provided by carbonation that many people enjoy.

Another solution involves the use of a complicated cap system for a bottle or container including a plurality of mechanical parts and piping for pressurizing and distributing carbonating gas into the liquid. However, this type of system is costly and difficult to clean, mainly due to the complexity and number of parts for the device.

A further solution involves the use of a carbonation tablet that can be dropped into a liquid container to produce the effervescence. This is a quick and easy way to carbonate the liquid, but the resultant product oftentimes includes an aftertaste that can overpower the taste of the potable liquid. Moreover, the chemical reaction can include some unpalatable solid byproducts. Thus, it would be a benefit in the art to provide an efficient and economical device for carbonating potable liquids with minimal adverse effects on the palate.

Thus, a carbonation device addressing the aforementioned problems is desired.

SUMMARY OF THE INVENTION

The carbonation device includes a cap system selectively mounted to the mouth of a liquid container. The cap system includes a cap, a syringe piston reciprocable within the cap, an actuating mechanism for reciprocating the syringe piston, and a reaction vessel selectively attached to the bottom of the cap. The syringe piston includes a storage area to be filled with water by repeated activation of the actuating mechanism. The water from the charged syringe piston discharges into the reaction vessel that has been filled with a preselected amount of reactants to initiate the carbonation reaction. In an alternative embodiment, the carbonation device includes a rotatable control ring to selectively puncture a $CO_2$ cartridge inside the reaction vessel or introduce reactant liquid, such as water, into the reaction vessel to initiate carbonation reaction. In both embodiments, the $CO_2$ flows from the reaction vessel into the container to carbonate the beverage contained therein.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
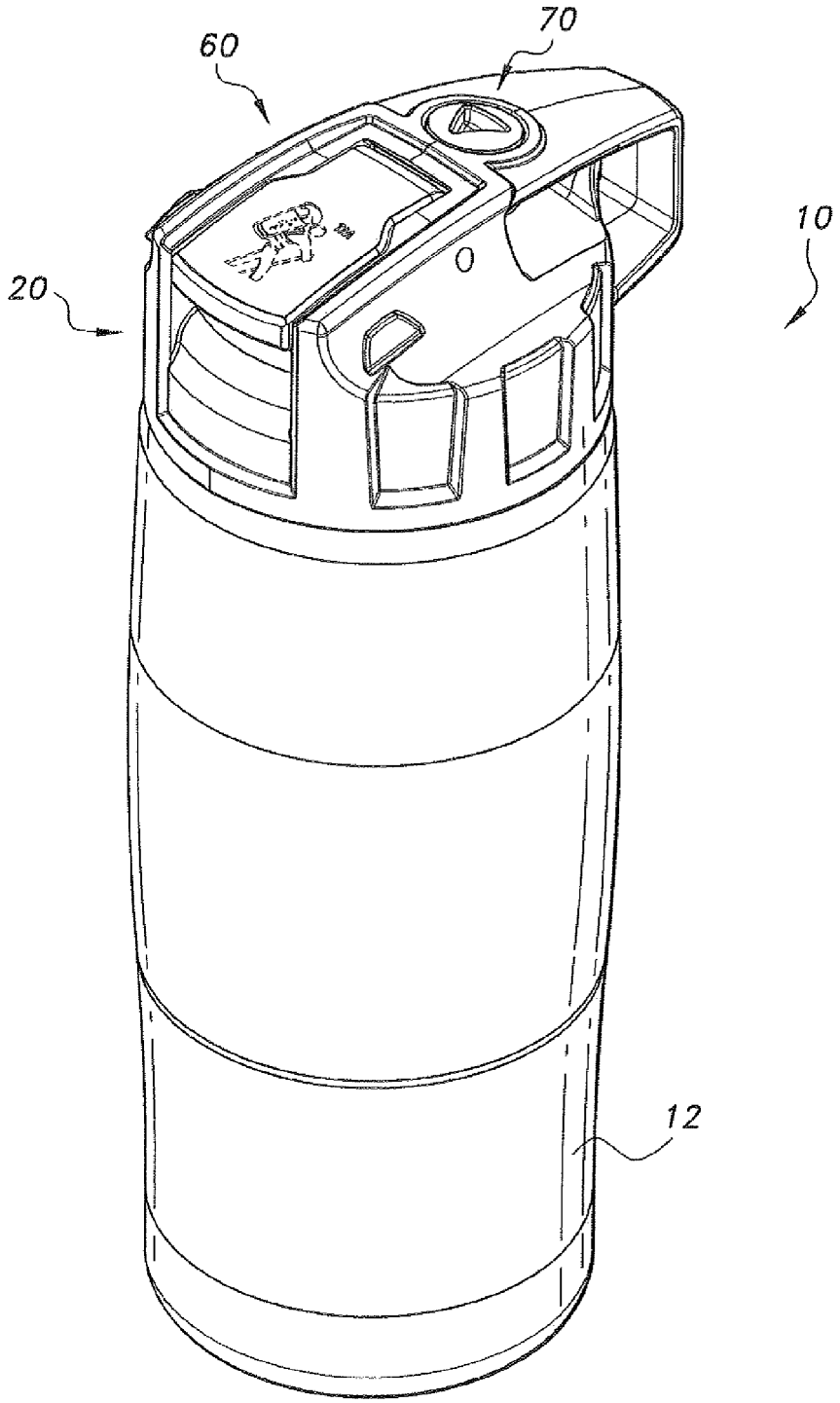
FIG. 1 is an environmental perspective view of a first embodiment of a carbonation device according to the present invention.
Figure 2:
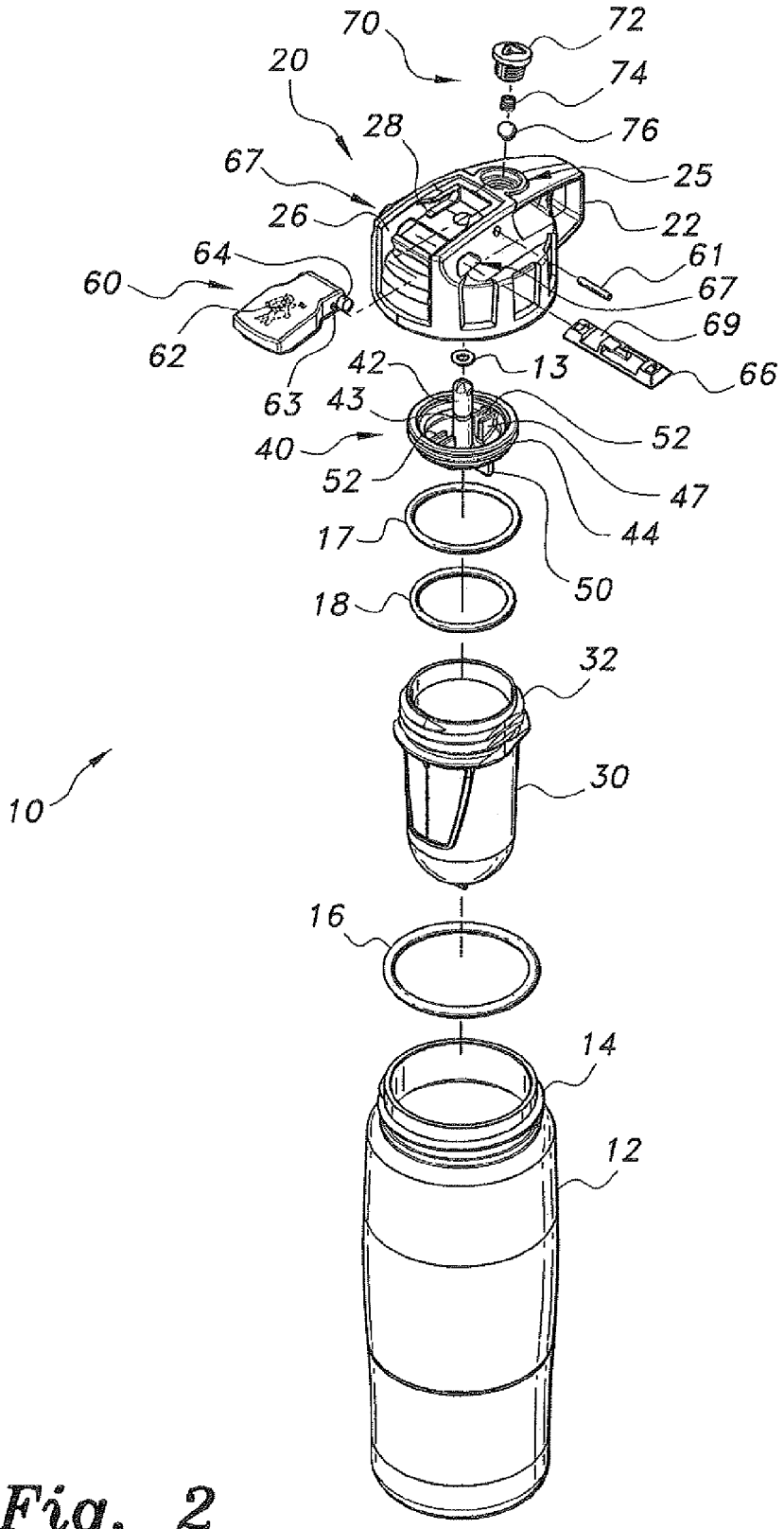
FIG. 2 is an exploded view of the carbonation device of FIG. 1.
Figure 3:
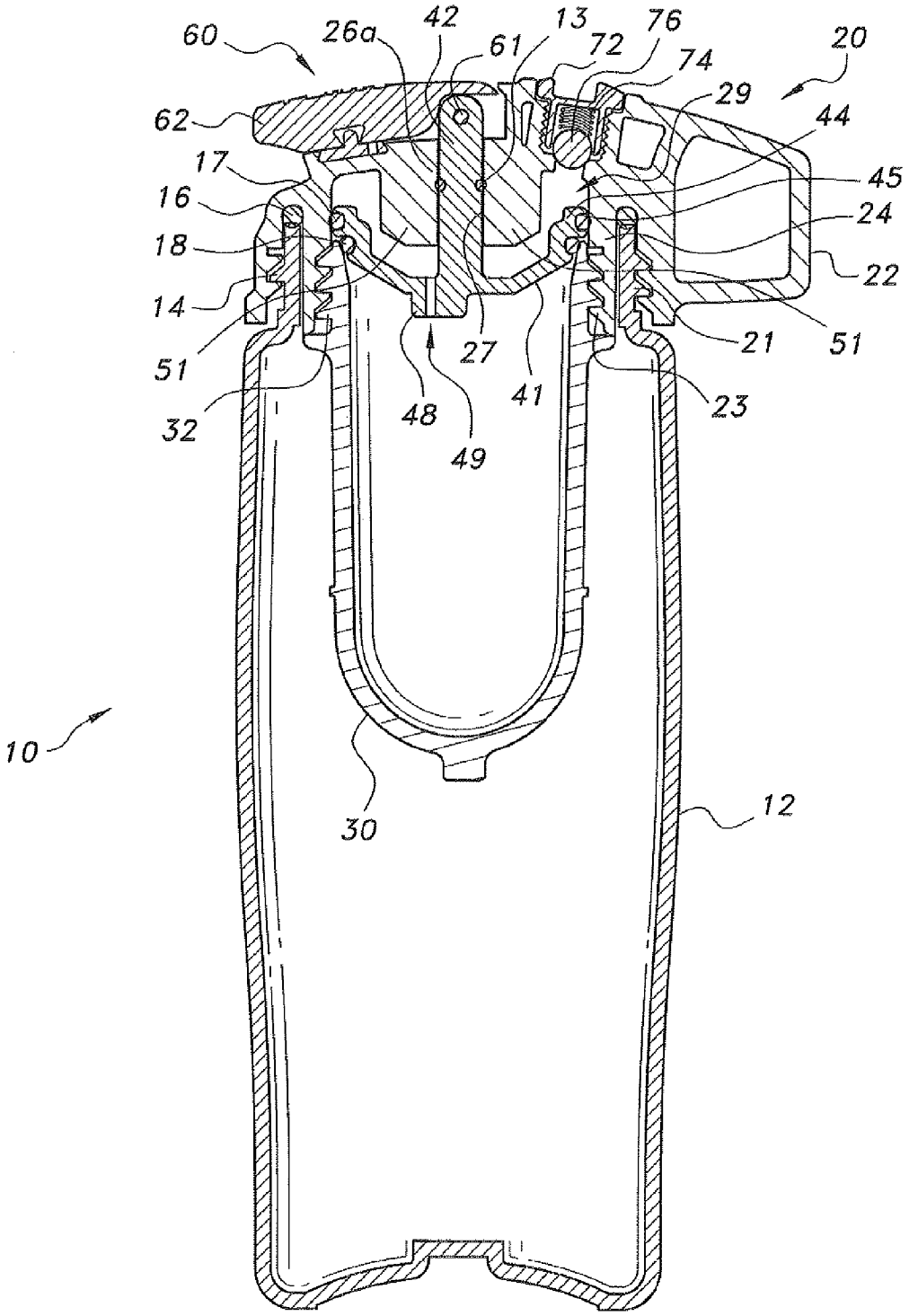
FIG. 3 is an elevation view in section of the carbonation device of FIG. 1.

The carbonation device is a device for producing carbonated beverages on demand in an efficient manner. As shown in FIGS. 1-3, in a first embodiment, the carbonation device 10 includes a cap 20 adapted to be mounted to a liquid container or water bottle 12 via threads. A carabiner loop or handle 22 extends from one side of the cap 20 for ease of transport or attachment to a backpack. The cap 20 includes a substantially hollow cylindrical body having internal threads 21 on the cap 20 that are adapted for mating with external threads 14 on the container 12. A concentric annular wall 24 is disposed inside the cap 20 and includes a plurality of internal threads 23 for mounting a reaction vessel or cup 30 with mating threads 32. The carbonation device 10 utilizes an endothermic reaction to produce carbonating gas, i.e. $CO_2$, within the reaction vessel 30. The gas feeds into the liquid, fluid or beverage to be carbonated from the reaction vessel 30 through the threads 32 towards the interior of the container 12. The threads 32 desirably do not extend continuously around the reaction vessel 30. Instead, the threads 32 are configured to have gaps or less restricted passages for gas or $CO_2$ to flow from the reaction vessel 30 into the container 12. To insure an airtight seal of the cap 20 during the carbonation process, a first O-ring 16 is disposed between the cap 20 and the container 12.

The reaction chamber or vessel 30 can be a substantially hollow body having a dome-shaped closed end and an opposite open end. The outer surface of the reaction vessel 30 can also include grip-enhancing protrusions to assist in handling and mounting. Various types of grip enhancing features can also be included. Moreover, the reaction vessel 30 is desirably made from plastic or other durable materials that can withstand the pressures experienced by the reaction vessel 30 in a safe manner. Similar materials are applicable to the container 12.

In order to produce the $CO_2$ for carbonation, the reaction vessel 12 is filled with a predetermined amount of carbonating material, such as sodium bicarbonate and citric acid, either in powder or tablet form. By mixing the sodium bicarbonate and citric acid with a reactant liquid, such as water, carbonating gas, such as $CO_2$, can be formed therein and distributed. The reactant liquid, such as water, is supplied by a syringe piston 40, which serves as both a means of delivering reactant liquid, such as water, to the reaction vessel 30 and as a valve for delivering the $CO_2$ to the container 12. In general, the supplied reactant liquid, such as water, reacts with the carbonating material pressurizing the reaction vessel 30. Once pressure has been built to a desired level, the syringe piston 40 is raised from the top of the reaction vessel 30 to open a passage for the gas to escape into the container 12.

Figure 4:
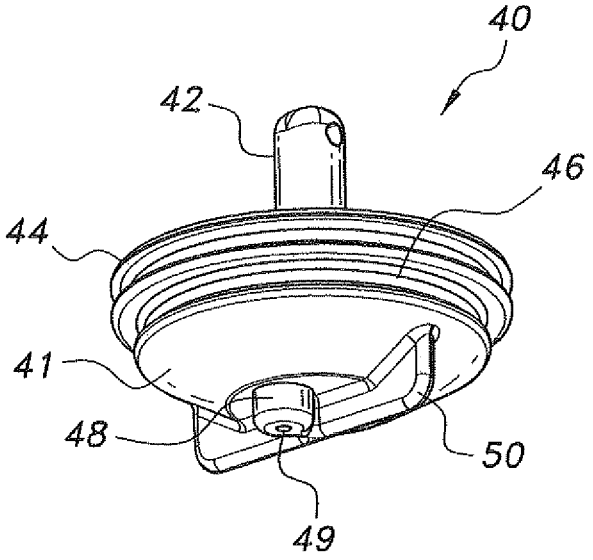
FIG. 4 is a bottom perspective view of the syringe piston in the carbonation device of FIG. 1.

As shown in FIGS. 2-4, the syringe piston 40 is configured as a bowl or cup 41 for holding the reactant liquid, such as water, therein. It should be recognized that the configuration of the bowl 41 is not limited to just water as a reactant liquid. The bowl 41 can also hold and transfer gases as the reactant liquid. The bowl 41 can be shaped in a variety of ways to accommodate the specific volume of material to be moved or held by the syringe piston 40. The bottom of the bowl 41 includes outwardly extending ribs or walls 50, serving as a handle for installation thereof. An actuating mechanism, which will be further detailed below, reciprocates the syringe piston 40 within the cap 20. A shaft or rod 42 centrally disposed on the syringe piston 40 rides or slides within a central bore 27 on the cap 20. Thus, the bore 27 defines the path of travel for the syringe piston 40. The shaft 42 includes an annular groove 43 where a shaft O-ring 13 can be inserted to provide an airtight and watertight seal in the bore 27 during reciprocation of the syringe piston 40.

The syringe piston 40 also includes additional seals to provide a pressure-tight seal. A radially extending flange 44 at the top of the syringe piston 40 includes an annular groove or channel defined therein for a second, relatively large diameter O-ring 17. A third, smaller O-ring 18 is desirably disposed below the flange 44 within the annular groove or channel 46 such that when the reaction chamber or vessel 30 is threaded to the bottom of the cap 20, and the syringe piston 40 is plunged downward, the third O-ring 18 seals against the open end of the reaction vessel 30 and closes the reaction vessel 30 of from the beverage container, thereby stopping the flow of $CO_2$ gas into the beverage. Thus, the third O-ring 18 can also be referred to as a valve ring. Alternative arrangements can be possible with the third O-ring 18, depending upon the geometry and location of the reaction vessel $CO_2$ exhaust ports. In a desired embodiment, the entire open end of the reaction cup becomes the required sealing surface to close the flow of $CO_2$ gas from entering the beverage. However, other $CO_2$ exhaust path mechanisms, such as a centrally disposed straw, can require corresponding resizing and repositioning of the third O-ring 18.

During operation of the syringe piston 40, the syringe piston 40 can tend to rotate from the frictional contact with the O-rings 17 and 18. If left unchecked, this action tends to place rotational strain on the connection between the syringe piston 40 and the actuating mechanism, which can lead to structural failure or deformation. As shown in FIGS. 2 and 3, the carbonation device 10 includes an anti-rotation assembly preventing the syringe piston 40 from rotating. In FIG. 2, the interior of the bowl 41 includes a pair of spaced diametrically extending fins, ribs or walls 47 extending from opposed sides of the shaft 42. The spacing between each set of fins 47 forms an anti-rotation slot 52. The central column 26*a* includes a pair of radially extending anti-rotation fins, ribs or walls 51 (FIG. 3) that slidably fit within the respective anti-rotation slots 52. This connection insures that the syringe piston 40 reciprocates vertically and will not substantially rotate. In addition to forming an anti-rotation assembly, the anti-rotation fins 47 also reinforce the walls of the bowl 41 and thereby maintain the shape of the bowl or cup 41.

The bottom of the syringe piston 40 also includes a downwardly extending post or bushing 48 having a through bore or port 49. The port 49 permits transfer of fluid or gas between the reaction vessel 30 and the bowl 41.

Figure 5:
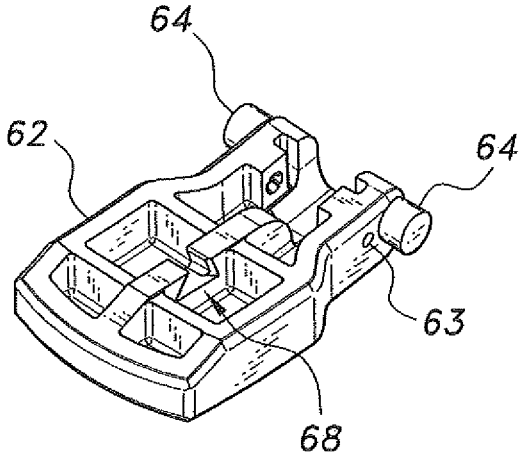
FIG. 5 is a bottom perspective view of the lever on the carbonation device of FIG. 1.

As shown in FIGS. 2, 3 and 5, the actuating mechanism 60 can include a cam lever 62 disposed within a recess 26 on top of the cap 20. The lever 62 is pivotally connected to the piston shaft 42 via a pin, bar or rod 61. The pin 61 is threaded through corresponding bores 63 on the lever 62 and a pivot bore on the piston shaft 42. The lever 62 includes at least one follower 64 adjacent the bore 63. The follower(s) 64 rides in corresponding cam channels, grooves or slots 28 disposed within the recess 26. The follower(s) 64 also defines the pivot axis of the lever 62. Selective operation of the lever 62 up or down results in a corresponding raising or lowering motion of the syringe piston 40. Since the central bore 27 limits the shaft movement vertically, the action of the follower(s) 64 and cam channels 28 ensure that movement of the pivotal connection between the lever 62 and the shaft 42 is also limited vertically due to the pivot axis being variable during the operation of the lever 62. Although the above exemplary embodiment is desirable, other mechanical mechanisms that provide mechanical advantage for moving the syringe piston 40, such as a four-bar linkage or a threaded rotational actuating cap, can also be used.

The actuating mechanism 60 can also include a locking assembly for keeping the lever in the inoperative or down position, especially for transport. Another main aspect for the locked position is that the locked position seals the syringe piston 40 against the top of the reaction vessel 30 whenever needed, i.e., the locked position closes the valve. The locking assembly includes a slidable locking bar, rod or beam 66 received in correspondingly spaced mounting slots 67 formed in the recess walls of the recess 26. The locking bar 66 can be an elongate beam having a substantially trapezoidal shape in cross section. A central rib on the bottom of the lever 62 includes a locking slot 68 corresponding to the cross-sectional shape of the locking bar 66 to form a dovetail join when the locking bar 66 is in the locked position. To release the lock, the user slides the locking bar 66 until an unobstructed zone 69 mates with the locking slot 68, where the dovetail join cannot form. In this position, the lever 62 is free to move. Other locking mechanisms, such as latches or spring locks, can also be used.

During operation of the carbonation device 10, the interior pressure can at times require release. In that regard, the carbonation device 10 includes a pressure relief valve 70 disposed in the recess 26 on top of the cap 20 adjacent the actuating mechanism 60. The pressure relief valve 70 includes an elastomeric ball 76 covering a relief hole or bore 29. The ball 76 is held in place by the combined action of the biasing means, such as a spring 74 and a nut 72 threaded into the recess 26. The spring 74 holds the ball 76 against the bore 29 and is desirably configured to withstand a certain amount of pressure prior to having the ball 76 forcibly moved away from the bore 29 when the internal pressure overcomes the strength of the spring 74. Various springs, such as a clip spring or an elastomeric sleeve, are viable alternatives for the relief valve 70.

The following describes how to use the carbonation device 10. When a user desires to carbonate a beverage, the cap 20 is removed from the container 12 to remove the reaction vessel 30. The container 12 is filled with some reactant liquid, such as water, and the cap 20 replaced. The container 12 is turned upside down so that the reactant liquid, such as water, pools toward the cap 20. The lever 62 is then unlocked and pivoted up and down repeatedly to reciprocate the syringe piston 40. The reciprocation of the syringe piston 40 creates a vacuum that pulls the reactant liquid, such as water, into the cup 41 through the port 49. The cup or bowl 41 is completely filled, such as when substantially no more air bubbles escape through the port 49.

Once the cup or bowl 41 filled with the reactant liquid, such as water, the reaction vessel 30 is filled with a predetermined amount of carbonating reactants and mounted to the cap 20. The container 12 is then filled with the liquid, such as a fluid or a beverage, to be carbonated, and the cap 20 is reattached. In the upright position, the lever 62 is cycled several times to dispense the reactant liquid, such as water, through the port 49. The reactant liquid, such as water, contacts the effervescent reactants within the reaction vessel 30 and triggers the start of the chemical reaction. After a short period of time, the lever 62 is placed in the up position to open the top of the reaction vessel 30, which permits flow of the carbonating gas from the reaction vessel 30 into the beverage. It is noted that during this operation, the configuration of the syringe piston 40 and the limited travel facilitated by the piston shaft 42 allows for only a fraction of the reactant liquid, such as water, to be dispensed into the reaction vessel 30 at a time. While it is possible to empty the full contents of the syringe piston 40 at one time with corresponding modifications of, inter alia, the syringe piston 40 and the reaction vessel 30, such a configuration can cause a difficult to control reaction with the carbonating reactants, i.e., the reaction and pressure buildup can be too rapid. To help prevent this type of occurrence, the carbonation production is staggered by using discreet amounts of reactant liquid, such as water, per cycle until typically all the reactant liquid, such as water, has been consumed. Thus, carbonation occurs over a longer period of time for a more even and thereby efficient consumption and absorption of the gas into the beverage.

As naturally occurs, the gas production reaches equilibrium where carbonation is at a minimum. At this point, the user operates the lever 62 into the down position, closing the reaction vessel 30. The user then locks the lever 62 and shakes the carbonation device 10 vigorously for a short time. This agitation serves two purposes. The first purpose results in increased production of carbonating gas by increasing the reaction between the reactants. The second purpose results in forcing the remaining gas in the container 12 to be absorbed into the beverage due to the beverage moving inside the container 12. Both result in optimizing carbonation of the beverage.

When the newly generated $CO_2$ reaches a desired pressure level, the lever 62 can be raised to the up position to thereby open the top of the reaction vessel 30 and allow the gas to escape into the beverage. The above is repeated until the beverage has been carbonated to the user's satisfaction.

Thus, it can be seen that the carbonation device 10 is a compact, efficient apparatus for producing carbonated beverages on demand. The syringe piston 40 performs the functions necessary for producing and delivering the carbonating gas in an efficient and relatively simple manner. The construction of the carbonation device 10 also permits easy assembly and disassembly for storage, travel and cleaning.

Figure 6:
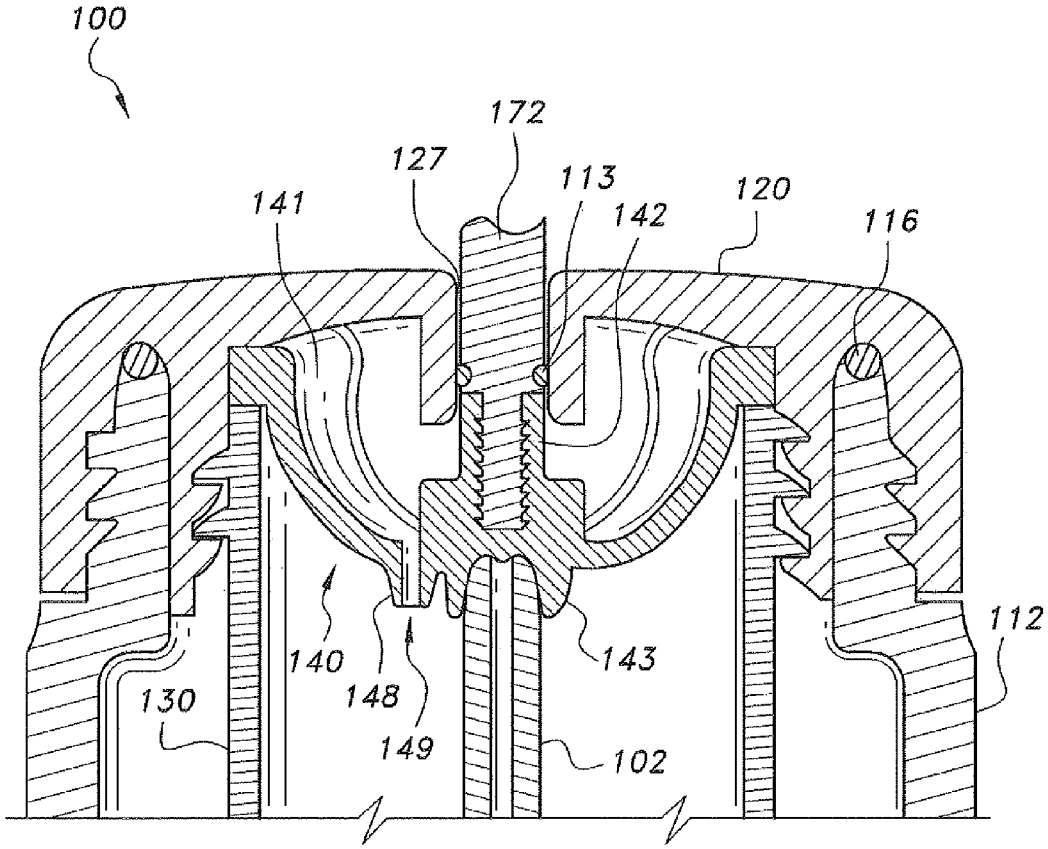
FIG. 6 is a partial environmental elevation view in section of another embodiment of a carbonation device according to the present invention.

The above exemplary embodiment utilizes a relatively stiff syringe piston 40. However, a more flexible one can be used to obtain similar results. As shown in FIG. 6, another embodiment of a carbonation device 100 is substantially the same as the carbonation device 10. The carbonation device 100 includes a cap 120 adapted to be mounted to the container 112 and a reaction chamber or vessel 130 is mounted below the cap 120. An O-ring 116 seals the connection between the cap 120 and the container 112.

Instead of a relatively stiff syringe piston, the carbonation device 100 includes a flexible diaphragm syringe piston 140. The diaphragm syringe piston 140 includes a bowl or cup 141 and a central piston rod or shaft 142 attached to an actuating rod or shaft 172 via threads or locking barbs. An O-ring 113 surrounds the actuating shaft 172 to seal reciprocation within the central bore 127 on the cap 120. The bottom of the diaphragm syringe piston 140 includes a downwardly extending post or bushing 148 having a throughbore or port 149. The port 149 permits transfer of fluid or gas between the reaction vessel 130 and the bowl 141. Moreover, a central flange 143 is formed at the bottom of the diaphragm syringe piston 140. The central flange 143 includes a recess for receiving one end of a distribution tube or straw 102. The other end of the distribution tube 102 opens into the interior of the container 112. Also, the carbonation device 100 can include a lancing mechanism to facilitate use of a $CO_2$ cartridge.

In most respects, the carbonation device 100 operates substantially the same as the carbonation device 10. However, reciprocation of the actuating shaft 172 flexes the diaphragm syringe piston 140, creating a vacuum and a pumping action for intake and discharge of fluid or gas. When a carbonating gas is produced and the pressure builds, the pressure inside the reaction vessel 130 lifts the central flange 143, permitting $CO_2$ to escape through the distribution tube 102 into the beverage contained in the container 112.

Another embodiment of the carbonation device is shown in FIGS. 7-10. The carbonation device 200 is a universal type that uses reactants or $CO_2$ cartridges. As shown, the carbonation device 200 includes a cap 220 adapted to be selectively mounted to a liquid container or water bottle 212; a control ring, valve or manifold 240 coaxially mounted and rotatable with respect to the cap 220; a reaction chamber, container or vessel 260 detachably mounted to the bottom of the cap 220;

and a carbonating gas distribution tube or straw 272 or $CO_2$ cartridge 274 detachably mounted to the bottom of the cap 220 adjacent the reaction vessel 260. Various ports and vents in the cap 220 and the control ring 240 align with each other at preselected rotated positions of the control ring 240 for each stage of the carbonation process.

Figure 8:
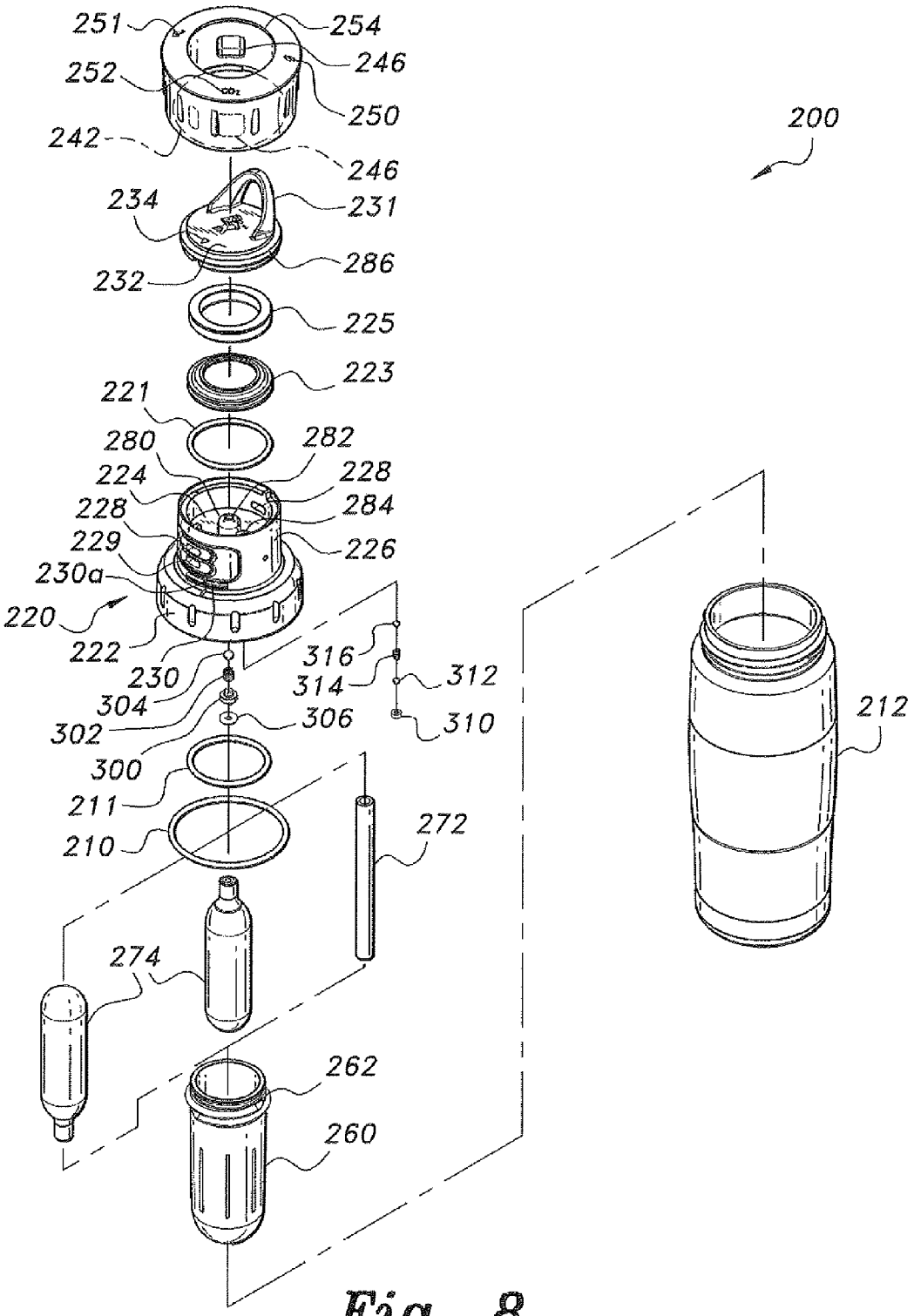
FIG. 8 is an exploded view of the carbonation device shown in FIG. 7.

Turning to FIG. 8, the cap 220 includes a tiered or telescoping cylindrical body having an upper, first body portion 226 and a lower, second body portion 222. The first body portion 226 has a smaller diameter than the second body portion 222. The larger diameter second body portion 222 forms a ledge upon which the control ring 240 can be mounted and rotated. The outer edge of the second body portion 222 can include indentions, protrusions or other grip enhancing features. The second body portion 222 forms a substantially annular ring with internal threads 224 for mounting the cap 220 onto the container 212 via corresponding threads 214. This connection is sealed by a first O-ring 210. The cap 220 also includes internal threads 218 inside the first body portion 226 adapted to mate with matching threads 262 on the reaction vessel 260. A second O-ring 211 provides a pressure-tight seal between the cap 220 and the reaction vessel 260.

The first body portion 226 includes a partition 226*a* separating the interior of the first body portion 222 into an upper chamber and a lower chamber. A pair of diametrically disposed upper ports, vents or holes 228 are formed on the upper chamber portion of the first body portion 226. These upper vents 228 permit flow of fluid or gas into the upper chamber. Below each upper vent 228 is a corresponding lower port, vent or hole 229 that permits flow of fluid or gas through the lower chamber.

The control ring 240 is rotatably mounted to the first body portion 226 of the cap 220. The control ring 240 can be a cylindrical body having a smaller diameter open top 254. To facilitate secure operative engagement therebetween, the control ring 240 includes discontinuous interior flanges or tabs 242 projecting radially inwardly from near the bottom of the interior of the control ring 240. These tabs 242 include locking notches or indentions that are disposed in the internal annular groove or channel 244 at predefined positions around the inner circumference of the control ring 240. Each notch indention corresponds to a selected control position for operation of the carbonation device 200. The first body portion 226 includes at least two rotation tabs 230 extending radially outwardly from the exterior surface of the first body portion 226. Each rotation tab 230 includes a locking protuberance 230*a* engageable with the above-mentioned locking indentions in the control ring 240 when assembled. The interaction between the locking protuberances 230*a* and the locking indentions locks the relative positions of the control ring 240 about the cap 220 for select operations of the carbonation device 200.

Figure 7:
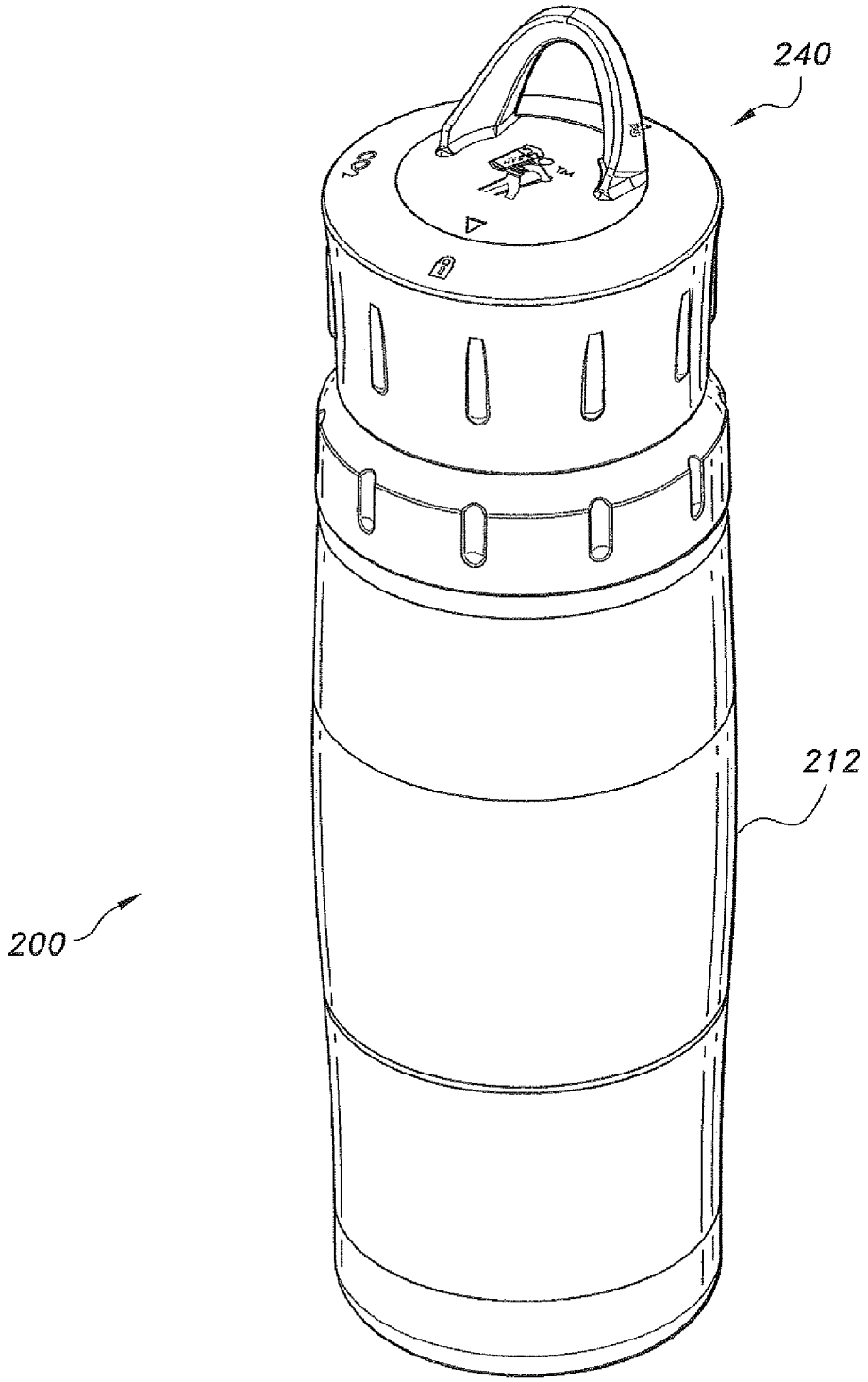
FIG. 7 is an environmental perspective view of still another embodiment of a carbonation device according to the present invention.

The interior of the control ring 240 also includes a pair of diametrically opposed control grooves or vents 246 that align and communicate with the upper vents 228 and the lower vents 229 when the control ring 240 is rotated to a select position. As shown in FIGS. 7 and 8, the top portion of the control ring 240 includes a plurality of indicia 250-252. The indicium 250 refers, e.g., to an "unlocked" position in which the control ring 240 can be removed from the cap 220 for cleaning purposes. The indicium 251 refers, e.g., to the "$CO_2$" position, which aligns the control grooves 246 with the upper and lower vents 228 and 229. The indicium 252 refers, e.g., to a "locked" position in which the upper and lower vents 228 and 229 are blocked so that the carbonation device 200 can be transported or for shaking the carbonation device 200.

As shown in FIG. 8, the upper chamber of the cap 220 is open. To cover the same, the carbonation device 200 includes a vertically movable top cover 232 that, when assembled, forms an enclosed upper chamber. The cover 232 includes a radially extending circular flange 236 abutting the underside of the top portion of the control ring 240, which prevents the same from falling out of the control ring 240. A sealing ring 225 on top of an annular spring 223 insures a pressure-tight seal. An intermediate control plate or piston 238, the function of which will be further explained below, includes a downwardly extending protrusion, extension or button 239. The control plate 238 is disposed between the cover 232 and the top of the upper chamber in the cap 220. The cover 232 also includes a pointer indicium 234, which serves as a guide for selectively positioning the control ring 240 at the desired position. This is facilitated by aligning the respective indicia 250-252 with the pointer indicium 234. The cover 232 can include a carabiner ring or loop 231 for transport or attachment to a backpack.

To regulate pressure and distribution of fluid or gas, the carbonation device 200 can include several pressure relief valves. The first pressure relief valve is formed at the center of the partition 226*a*. A first relief valve housing 280 extends through the center of the partition 226*a*. The upper half of the first relief valve housing 280 includes an opening 282 through which gas can escape into the upper chamber. The upper half houses a ball 304 biased against the opening 282 by a spring 302. The lower half of the valve housing 280 includes a hollow lance or spear 300 with a point for piercing the nipple of a $CO_2$ cartridge 274.

The lance 300 is shaped like a flanged bushing with the pointed end disposed towards the interior of the reaction vessel 260 or the container 212. The flanged portion of the lance 300 abuts against a stepped portion of first relief valve housing 280 on one side. A retention O-ring 306 helps to retain the lance 300 within the first relief housing 280, as well as sealing the interior for optimum flow of medium. As previously mentioned, the lance 300 is hollow and includes a bore or passage 301 permitting the flow of medium between the upper and lower chambers of the cap 220. Pressure is relieved either by forceful uncovering of the opening 282 by the button 239 pressing down on the ball 304, or by lessening of the interior pressure over time. The relief over time releases some of the compression on the spring 302 via the lance 300, which consequently permits the ball 304 to lower and uncover the hole or port 282.

A second pressure relief valve housing 284 is disposed adjacent the first relief valve housing 280. The second pressure relief valve housing 284 encloses balls or obstructions 312, 316 disposed on opposite sides of a spring 314. The spring 314 and the balls 312, 316 are retained within the second relief valve housing 284 by a retention sealing ring 310. As an alternative, a third pressure relief valve can be disposed at the bottom of the reaction vessel 260 to selectively relieve pressure therein. The third pressure relief valve can be of similar construction to the first relief valve.

Figure 9:
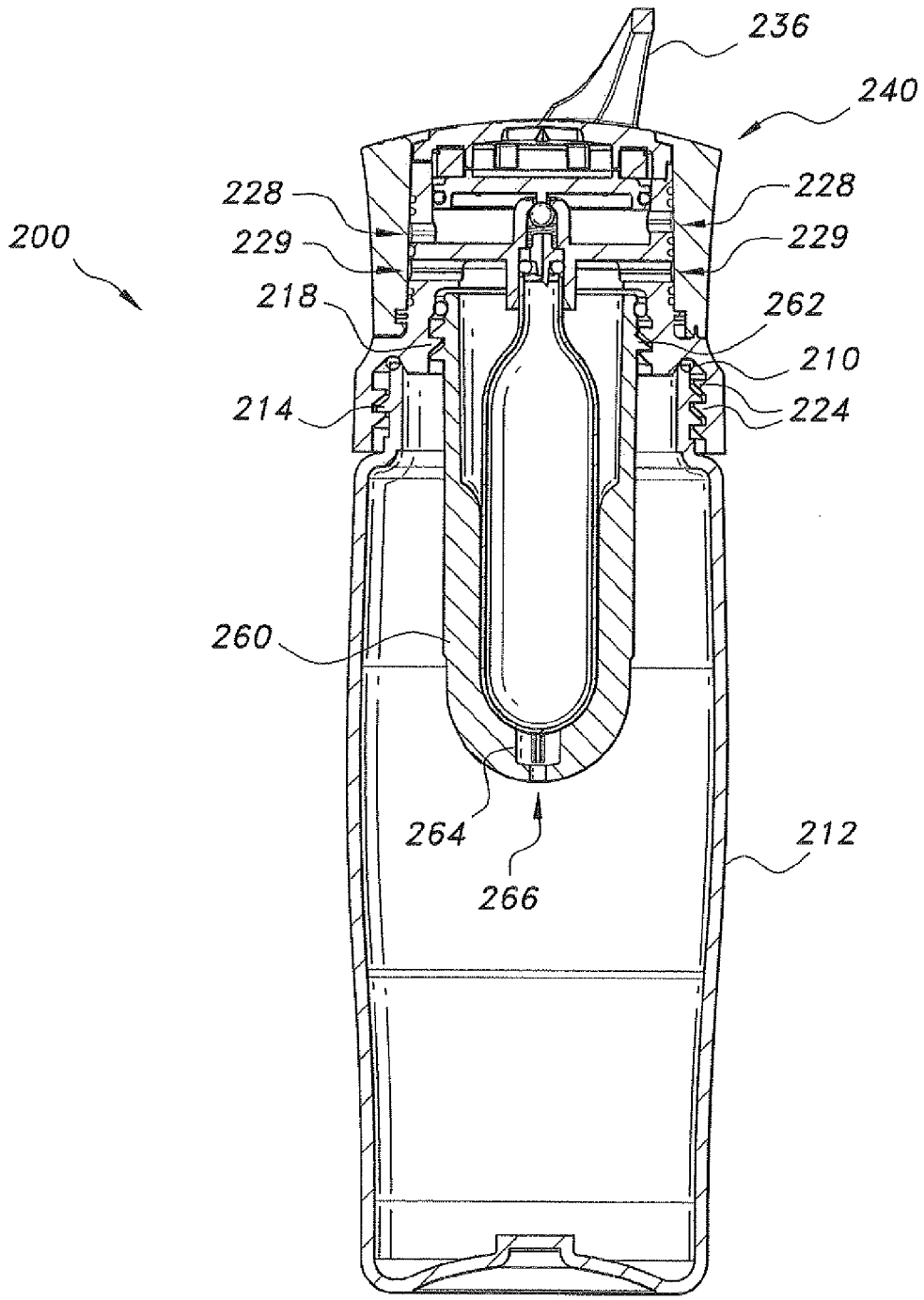
FIG. 9 is an elevation view in section of the carbonation device shown in FIG. 7.
Figure 10:
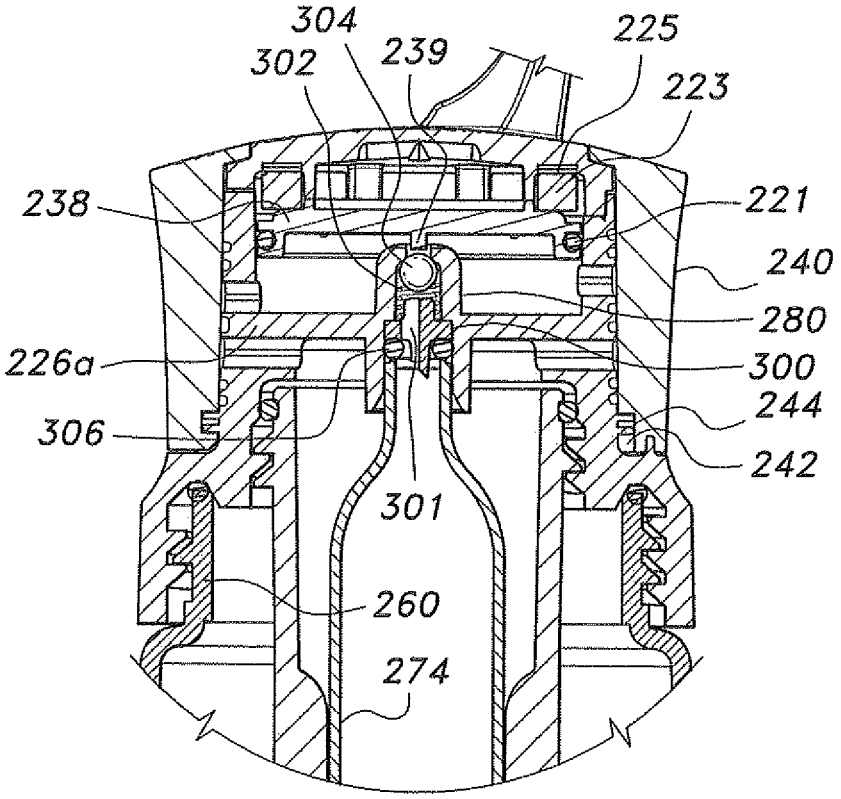
FIG. 10 is a partial elevation view in section of the carbonation device shown in FIG. 9.

As mentioned, the universal carbonation device 200 utilizes carbonating gas either from reactants or from a $CO_2$ cartridge 274. Both are facilitated through the reaction vessel 260. As shown in FIGS. 8 and 9, the reaction vessel 260 includes a mounting recess 264 in communication with a vent, port or hole 266, through which carbonating gas exits into the interior of the container 212.

When the cartridge 274 is to be used, the cartridge 274 can normally be stored upside down so that the nipple of the cartridge 274 is mounted inside recess 264. When using reactants, a distribution tube 272 is installed inside the reaction chamber 260 with one end attached to the lower portion of the first relief valve housing 280 and the other end attached to the mounting recess 264.

The following describes how to use the universal carbonation device 200 using either carbonating source. In the first example, using the cartridge 274, the user rotates the control ring 240 into the "locked" position to facilitate insertion of the cartridge 272. The cap 220 is threaded onto the reaction vessel 260 forcing the nipple of the cartridge 274 to move towards the lance 300 and be pierced thereby. Then the cap 220 is attached to the container 212. The $CO_2$ gas exits the cartridge and travels through the lance 300 and the first pressure relief valve housing 280. Then the gas enters the upper chamber under the piston 238. The pressure within this region increases until the pressure generates enough force to lift the piston 238 against the opposing force of the spring 223 above. When the piston 238 lifts, this action releases the ball 304, allowing the ball 304 to seal against the port 282. At this point, pressure is permitted to build.

To initiate carbonation of the beverage in the container 212, the user rotates the control ring 240 into the "$CO_2$" position aligning the vent control grooves 246 with the upper and lower vents 228 and 229. The gas trapped in the upper chamber flows through the upper vents 228 into the lower vents 229 towards the lower chamber. From there, the gas exits through the exhaust port 266 to carbonate the beverage.

As the gas exits the upper chamber, pressure is reduced therein. Since the annular spring 223 normally biases the piston 238 towards the first relief valve housing 280, the button 239 eventually presses down on the ball 304 to unseal the port 282. This permits residual pressure inside the cartridge 274 to transfer the remaining gas inside the cartridge 274. The user can shake the carbonation device 200 to force carbonate the beverage for substantially the dual purposes discussed above. When the desired carbonation has been reached, the beverage is ready to be enjoyed.

When using reactants, the user initially places the cap 220 upside down with the control ring 240 in the "$CO_2$" position, aligning the vent control grooves 246 with the upper and lower vents 228 and 229. The interior of the cap 220 forms a funnel, to which the user can add a reactant liquid, such as water, so that the reactant liquid, such as water, accumulates into the upper chamber. Once the upper chamber has been filled, the control ring 240 is rotated to the "locked" position, trapping the reactant liquid, such as water, in the upper chamber.

The reaction vessel 260 is filled with a predetermined amount of carbonating reactants, such as citric acid and sodium bicarbonate, and then attached to the cap 220. The whole assembly is then mounted to the container 212 that has been filled with the beverage to be carbonated. Once firmly attached to the container 212 and the distribution tube 272 is reattached, the control ring 240 is again rotated to the "$CO_2$" position, releasing the trapped reactant liquid, such as water, into the reaction vessel 260. The reactant liquid, such as water, and the reactants initiate production of carbonating gas.

The produced gas leaves the reaction chamber 260 through the lower vents 229 and into the upper chamber via upper vents 228. Since the annular spring 223 normally presses down on the piston 238, releasing the ball 304 and unsealing the port 282, the gas flows through the lance 300 and the tube 272 into the beverage. As the interior pressure slowly decreases over time, the lessening pressure becomes less than the pressure from the spring 302, at which point the ball 304 seals the port 282.

The user can vigorously shake the carbonating device 200 for a brief period of time after rotating the control into the "locked" position. The shaking helps to recharge the carbonating reaction. Then the control ring 240 can be returned to the "$CO_2$" position to recommence distribution of the carbonating gas. The above can be repeated until the desired carbonation has been reached. Then the beverage is ready to be enjoyed.

As with the carbonation device 10, embodiments of the carbonation devices 100, 200 are compact, efficient apparatus for producing carbonated beverages on demand. The endothermic reaction provides some cooling to the beverage. Moreover, the construction of the alternative carbonation devices 100, 200 permits easy assembly and disassembly for storage, travel and cleaning.

Figure 11:
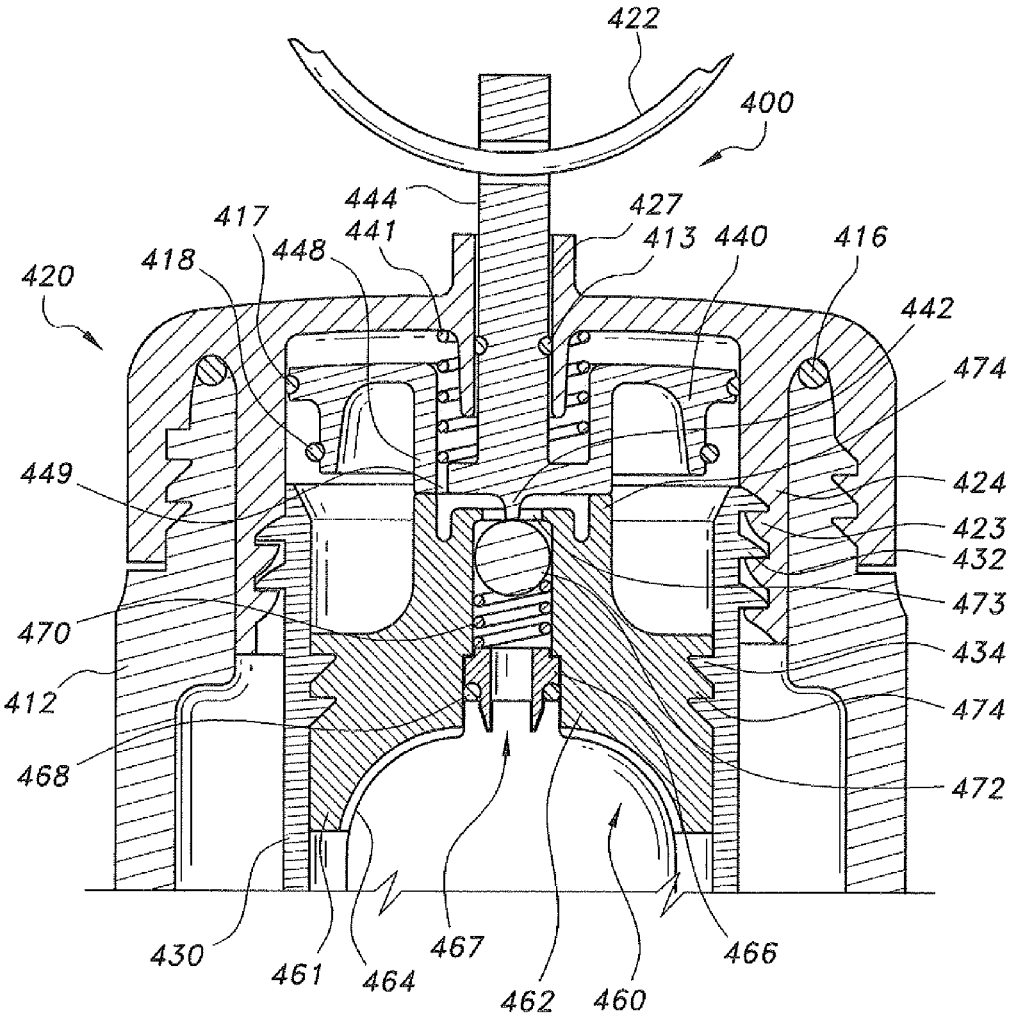
FIG. 11 is a partial environmental elevation view in section of another embodiment of a carbonation device according to the present invention.

Another embodiment of a carbonation device 400 is shown FIG. 11. This embodiment is a further example of a universal carbonation device using either carbonation reactants or a $CO_2$ cartridge including a separate lancing assembly.

As shown in FIG. 11, the carbonation device 400 includes a cap 420 adapted to be selectively mounted to a liquid container or water bottle 412 via threads. A first O-ring 416 provides a pressure tight seal between the cap 420 and the container 412. A concentric annular wall 424 is disposed inside the cap 420 and includes a plurality of internal threads 423 for mounting a reaction vessel or cup 430 with mating threads 432. As with the previous carbonation device 10, the threads 432 are configured with gaps or less restricted passages for gas or $CO_2$ to flow from the reaction vessel 430 into the container 412. The reaction vessel 430 can include a plurality of fins symmetrically oriented around the interior thereof. Moreover, the bottom of the reaction vessel 430 can include a recess similar to the recess 264 for securing a cartridge therein.

A reciprocating syringe piston 440 with a piston rod 444 reciprocates within a central bore 427 formed through the top of the cap 420 to selectively open or close the opening of the reaction vessel 430, i.e., a valve. The piston rod 444 is sealed from atmosphere by a piston seal O-ring 413. The bottom of the syringe piston 440 includes a downwardly extending post or bushing 448 having a through bore or port 449. The port 449 permits transfer of fluid or gas between the reaction vessel 430 and the upper portion of the syringe piston 440. A button 442 is formed adjacent the port 449, and the button 442 performs similar to the button 239. The carbonation device 400 includes a biasing means, such as the spring 441 disposed between the cap 420 and the bushing 448, to normally keep the syringe piston 440 in the down position, sealing the reaction vessel 430. The strength of the spring 441 is predetermined such that pressure from the reaction vessel 430 can move the syringe piston 440 to open the valve during the carbonation process. The bushing 448 and the upper portion of the syringe piston 440 define a bowl for storage and transfer of fluids and gases, as in the previous embodiments. The syringe piston 440 also includes a second, relatively large diameter O-ring 417 and a third, smaller diameter O-ring 418 providing the required seals for the syringe piston 440. Reciprocation of the syringe piston 440 can be facilitated by using the handle ring 422. Moreover, the carbonation device 400 can include a locking mechanism to keep the syringe piston 440 in the down or "locked" position.

When using carbonation producing reactants, the cap 420, container 412, syringe piston 440 and the reaction vessel 430 operate substantially similar to the carbonation device 100. In most respects, the biased syringe piston 440 functions similarly to the flexible diaphragm syringe piston 140. However, when the syringe piston 440 is raised, either manually via the handle ring 422, or by increased pressure from the reaction vessel 430, so that the product gas flows from the reaction vessel 430 through the gaps of the threads 432.

To use a cartridge in the carbonation device 400, the carbonation device 400 includes a lance valve assembly 460. The lance valve assembly 460 can be selectively attached to the interior of the reaction vessel 430 with matching external threads 474 on the lance valve assembly 460 and internal threads 434 in the reaction vessel 430. The lance valve assembly 460 includes a funnel-shaped body 461 having a central bore for installation of a ball 472, a spring 470, and a lance or spear 466. The lance 466 is retained in the bore by a retaining ring 468. The spring 470 biases the ball 472 against the opening or port 473 to normally close the port 473. The lance 466 includes a pointed end adapted to pierce the nipple of a cartridge and a bore or hole 467 permitting flow of gas from the pierced cartridge. The bottom of the body 461 is curved to conform with the shape of the cartridge, providing a secure mounting for the cartridge inside the reaction vessel 430. The upper portion of the body 461 includes an annular raised lip 474 extending upwardly a predetermined distance such that when the bottom of the syringe piston 440 rests thereon, a gap is maintained between the port 473 and the bottom of the syringe piston 440. In this manner, the gas is free to flow as long as the port 473 remains open. The raised lip 474 is configured to allow the flow of gas through the gaps of the threads 432 by discontinuities or gaps around the lip 474.

In use, the cartridge is installed inside the reaction vessel 430. The lance valve assembly 460 is threaded inside the reaction vessel 430 to secure the cartridge therein and simultaneously pierce the nipple thereof with the lance 466. Once the reaction vessel 430 is secured to the cap 420 and the cap 420 secured to the container 412, the piston rod 444 is pressed down manually or by the strength of the spring 441 to move the ball 472 with the button 442.

As the gas is released from the cartridge, the gas increases internal pressure that eventually overcomes the force of the spring 441 and slowly raises the ball 472 and the syringe piston 440. In the meantime, the gas flows through the threads 432 to carbonate the beverage. Vigorous shaking or agitation and repetition of the above increases carbonating gas production and absorption till the desired level of carbonation has been reached.

A still further embodiment of a carbonation device 500 is shown in FIGS. 12-16C. This embodiment includes a variety of features, such as a pressure relief system, that permits selective, active, and passive depressurization so as to prevent potential difficulties in operating the carbonation device 500, especially during instances of opening and closing the cap assembly, and such as a carbonating gas distribution system to dispense a carbonating gas into a liquid held in a liquid container. As with any twist-cap type containers or bottles containing a carbonated liquid, it can be difficult and messy to open such containers due to sudden release of trapped pressure.

As shown in FIGS. 12-15B, the carbonation device 500 includes a cap 520 adapted to be mounted to a liquid container or water bottle 512 via threads. Unlike the previous carbonation device 10, the container 512 is constructed with a dome-shaped or rounded bottom. The container 512 includes a threaded bottom section 502 for detachable mounting of a boot 504. The boot 504 includes interior threads 505 for selective attachment onto the container 512 and serves as a relatively flat base for keeping the carbonation device 500 upright on a support surface when attached. The boot 504 can also serve as a cup when detached from the container 512. The outer surface of the boot 504 can be provided with a smooth or patterned surface. In this exemplary embodiment, the boot 504 includes a pattern of regularly spaced depressions 507*a* and ridges 507*b* which provides structural rigidity and enhanced grip for the user. Similar functionality can be provided by other textured surfaces that are molded or separately placed on the boot 504. The container 512 can also be provided with gradation indicia 506, which can be in the form of printed, molded or etched markings, on the surface thereof as a visual indicator representing or calculating the amount of liquid in the bottle 512.

Figure 13:
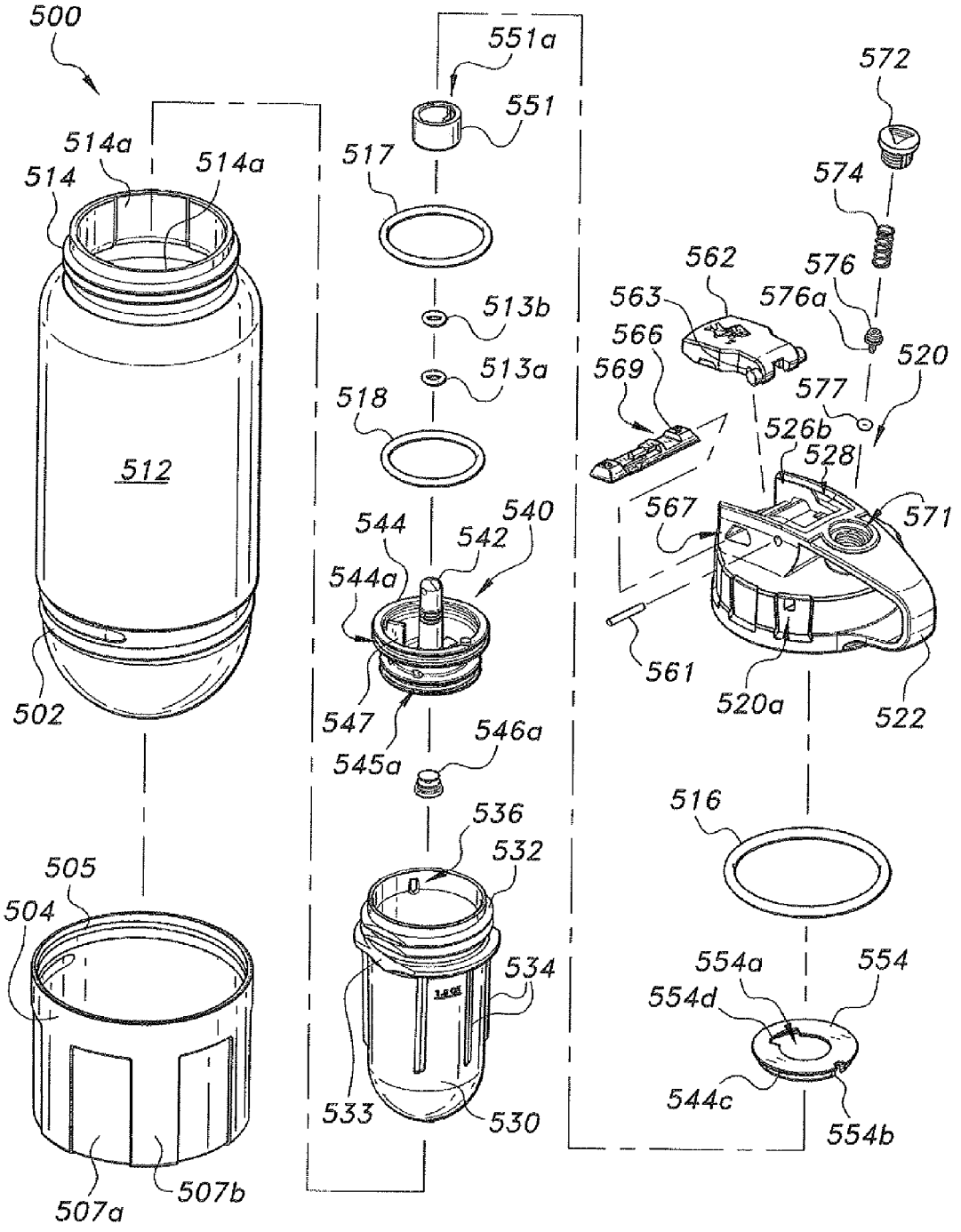
FIG. 13 is an exploded view of the carbonation device shown in FIG. 12.
Figure 14:
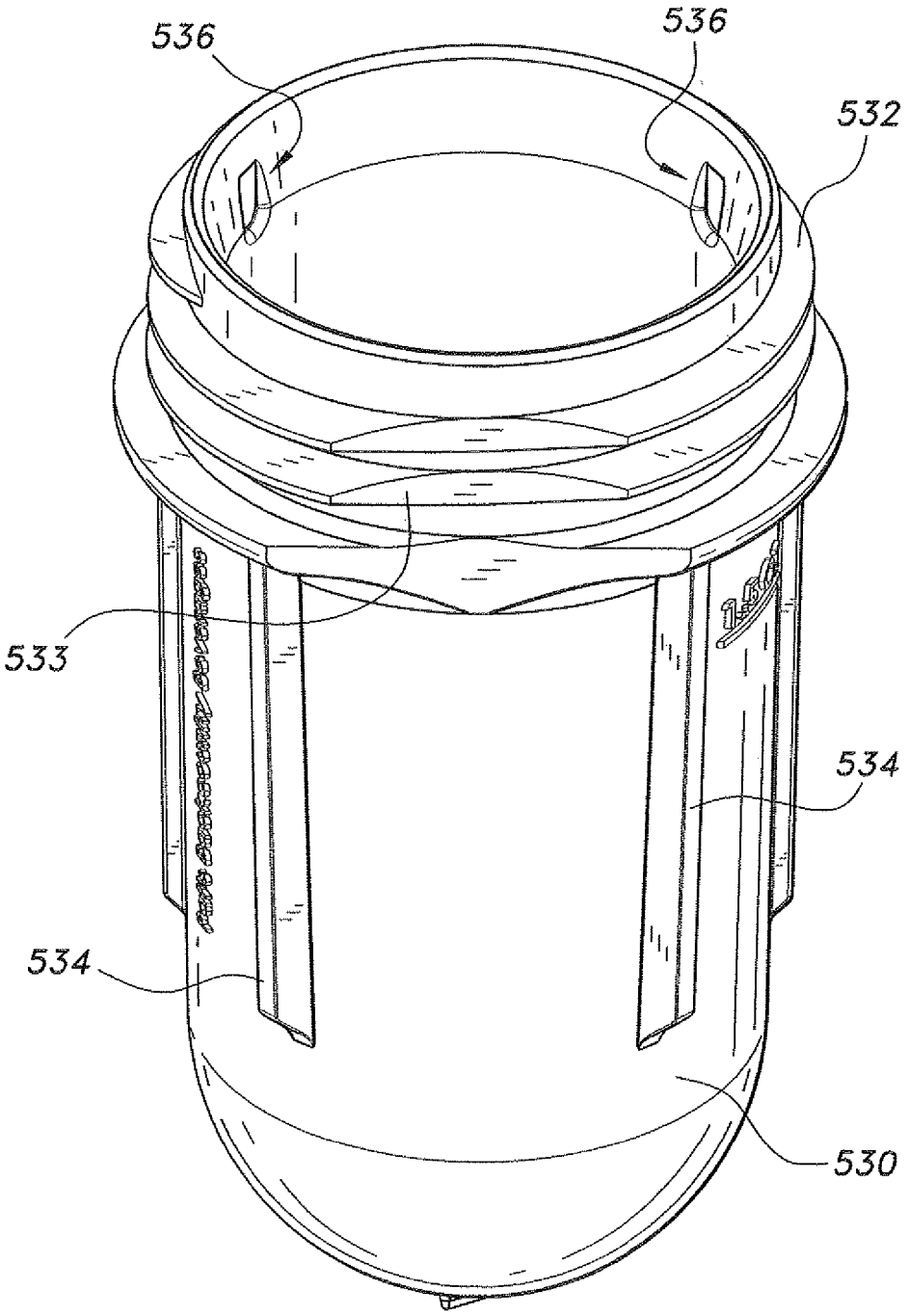
FIG. 14 is a perspective view of the reaction vessel in the carbonation device shown in FIG. 12.

A carabiner loop or handle 522 extends from one side of the cap 520 for ease of transport or attachment to a backpack or any other means for securely hanging the carbonation device 500. The cap 520 includes a substantially hollow cylindrical body having internal threads 521 on the cap 520 that are adapted for mating with external threads 514 on the container 512. A concentric annular wall 524 is disposed inside the cap 520 and includes a plurality of internal threads 523 for mounting a reaction vessel or cup 530 with mating threads 532. The carbonation device 500 utilizes an endothermic reaction to produce carbonating gas, i.e. $CO_2$, within the reaction vessel 530. The gas feeds by the carbonating gas distribution system into the liquid, such as a fluid or a beverage, to be carbonated from the reaction vessel 530 through gaps associated with the threads 532 towards the interior of the container 512. The threads 532 desirably do not extend continuously around the reaction vessel 530. Instead, the threads 532 are configured to have gaps or less restricted passages for gas or $CO_2$ to flow from the reaction vessel 530 into the container 512. One example of such gaps or non-restricted passages is best seen in FIGS. 13 and 14 where the threads 532 are constructed with discontinuities 533 on diametric opposing sides of the reaction vessel 530.

To insure an airtight and/or watertight seal of the cap 520 during the carbonation process, a first O-ring 516 is disposed between the cap 520 and the container 512. While this seal is needed to facilitate infusion of carbonating gas into the liquid, the pressure within the container 512 will continuously increase over time unless relieved in some manner or until the reactants have been completely consumed. Even in the case of the latter, residual gas and the pressure associated therewith still exist. For example, this type of situation can lead to difficulties in unscrewing the cap 20 from the container 12 in the previously described carbonation device 10, mainly due to the first O-ring 16 being forced to remain on the top edge of the neck opening of the container 12. In other words, the first O-ring 16 normally sits inside an annular groove in the interior of the cap 20, this annular groove being a trough at the top of the annular space between the internal threads 21 and the annular wall 24 as best seen in FIG. 3. However, the overpressure inside the container 12 can occasionally force the gas to deform the first O-ring 16 sufficiently to flow around the first O-ring 16. This kind of action traps the gas between the annular groove inside the cap 20 and the first O-ring 16. Thus, instead of the first O-ring 16 remaining inside the annular groove during removal of the cap 20 as desired, the first O-ring 16 remains on top of the neck from the gas pressure forcing the first O-ring 16 down and consequently maintain a seal during the uncapping process.

In order to compensate for these types of instances, the carbonation device 500 includes as a part of the pressure relief system a seal pressure relief means for relieving excess gas pressure from inside the container 512. The seal pressure relief means includes an annular groove 516*a* and at least one seal pressure relief vent 520*a*. Unlike the annular groove in the carbonation device 10, the annular groove 516*a* inside the cap 520 has been provided with an extended profile, i.e. instead of a rounded trough of substantially the same diameter as the cross section of the first O-ring 516, the annular groove 516*a* includes a more elongated or squared profile as best seen FIG. 16C. This profile forms a small gap between the wall of the annular groove 516*a* and the first O-ring 516. In this exemplary embodiment, the carbonation device 500 includes a pair of seal pressure relief vents 520*a* formed on either side of the carabiner handle 522. The vents 520*a* can also be referred to as holes, openings or windows. Each seal pressure relief vent 520*a* extends into the annular groove 516*a*, and the opening thereof is normally closed or covered by the first O-ring 516 inside the cap 520.

In operation, the profile of the annular groove 516*a* assists in directing the pressurized gas substantially perpendicularly towards the outer rim of the cap 520. If the pressure is especially strong, the pressure can be sufficient to deform the first O-ring 516*a*, and the gas will escape through the seal pressure relief vents 520*a* until a state of equilibrium has been reached. Thus, the pressure relief via the pressure relief vents 520*a* permits a much easier uncapping of the cap 520.

It should be noted that the first O-ring 516 still maintains an airtight and watertight seal despite the vents 520*a*, especially when the cap 520 is in the capped position, i.e. in the capped position, the first O-ring 516 is deformed to a certain extent by the threaded connection and the force therefrom which then forms a secure seal. The function of the seal pressure relief means is to relieve excessive gas pressure by allowing excess gas to leak out when the internal pressure is too high, i.e. an active pressure relief during uncapping. The seal pressure relief means also helps to prevent potential embarrassing messes from the carbonated liquid inside the container 512. As with carbonated sodas and other carbonated beverages, opening an agitated can or bottle can suddenly release the contents everywhere due to the abrupt pressure release. In contrast, when a user desires to drink the contents of the container 512, the initial unscrewing of the cap 520 provides some space where the first O-ring 516 can move, due to internal pressure, from the normal position covering the vent 520*a* to a position, at least partially, uncovering the vent 520*a* thereby unlocking the seal. This allows the gas to escape in a more gradual and controlled manner eliminating much of the potential disarray from expelled carbonated liquid at pressure. Alternatively, the first O-ring 516 will stay in place inside the annular groove 516*a* and deform upwardly to partially uncover the vent 520*a* from the bottom.

The container 512 also includes as a part of the pressure relief system a passive means of relieving pressure. As best shown in FIG. 13, the container 512 is provided with a plurality of container vents 514*a* disposed around the inner diameter of the neck portion of the container 512. These container vents 514*a* permit unhindered passage of gas from inside the container even when covered by the cap 520. Without these container vents 514*a*, situations can arise in which the tolerances between the annular wall 524 and the neck of the container 512 become so close as to form an effective sealed barrier. That leaves no room for the gas to escape, which can be problematic with excessive pressure buildup. However, the container vents 514*a* insure that gas can escape between the annular wall 524 and the neck. In this manner, the seal is concentrated on the interaction between the first O-ring 516 and the top of the neck rather than on any of the surrounding hardware. Additionally, this passive means of relieving pressure increases the functionality of the seal pressure relief means mentioned above. Both working in concert insures that some means exist for the excess pressure to escape and prevent any difficulties associated therewith. In this exemplary embodiment, the container vents 514*a* are substantially squared grooves spaced at regular intervals around the interior diameter of the neck and extending down towards the main body of the container 512. Also other shapes, such as corrugated waves and other geometric configurations, both regular or irregular, can be employed so long as they provide a passage through the length of the neck.

The reaction chamber or vessel 530 can be a substantially hollow body having a dome-shaped closed end and an opposite open end. The outer surface of the reaction vessel 530 can also include grip-enhancing protrusions to assist in handling and mounting. In this exemplary embodiment, the reaction vessel 530 includes a plurality of ribbing 534 angularly spaced around the reaction vessel 530. In addition to grip enhancement, the ribbing 534 increases the structural integrity of the reaction vessel 530 for withstanding the pressures therein. Various other configurations can be provided to enhance grip such as textured surfaces, friction enhanced layers and the like. The reaction vessel 530 is desirably made from plastic or other durable materials that can withstand the pressures experienced by the reaction vessel 530 in a safe manner. Similar materials are applicable to the container 512.

In order to produce the $CO_2$ for carbonation, the reaction vessel 530 is filled with a predetermined amount of carbonating material, such as sodium bicarbonate and citric acid, either in powder or tablet form. By mixing the sodium bicarbonate and citric acid with a reactant liquid, such as water, carbonating gas, such as $CO_2$, can be formed therein and distributed. The reactant liquid, such as water, is supplied by a syringe piston 540, which serves as both a means of delivering reactant liquid, such as water, to the reaction vessel 530 and as a valve for delivering the $CO_2$ to the container 512. In general, the supplied reactant liquid, such as water, reacts with the carbonating material pressurizing the reaction vessel 530. Once pressure has been built to a desired level, the syringe piston 540 is raised from the top of the reaction vessel 530 to open a passage for the gas to escape into the container 512.

As shown in FIGS. 13, 15A, 15B, and 16A-16C, the syringe piston 540 is configured as a bowl or cup 541 for holding reactant liquid, such as water, therein. It should be recognized that the configuration of the bowl 541 is not limited to just water as a reactant liquid. The bowl 541 can also hold and transfer gases as a reactant liquid. The bowl 541 can be shaped in a variety of ways to accommodate the specific volume of material to be moved or held by the syringe piston 540. An actuating mechanism, which will be further detailed below, reciprocates the syringe piston 540 within the cap 520. A piston shaft or rod 542 centrally disposed on the syringe piston 540 rides or slides within a central bore 527 on the cap 520, the central bore 527 being formed or defined within an elongate, central column 526 depending from the interior ceiling or top of the cap 520. Thus, the bore 527 defines the path of travel for the syringe piston 540.

The syringe piston 540 includes additional seals to provide a pressure-tight seal. An upper, circular radially extending flange 544 at the top of the syringe piston 540 includes an annular groove or channel 544*a* defined therein for a second, relatively large diameter O-ring 517. The second O-ring 517 can also be referred to as an upper piston O-ring. A lower circular flange 545 extends radially from the bottom of the syringe piston 540. The lower flange 545 also includes an annular groove or channel 545*a* for insertion of a third, smaller O-ring 518. The third O-ring 518 can also be referred to as a lower piston O-ring. Both the lower circular flange 545 and the third O-ring 518 are smaller in diameter with respect to the upper circular flange 544 and the second O-ring 517. A plurality of angularly spaced ribs or walls 550 extend between the lower circular flange 545 and the bottom outer surface of the bowl 541 providing structural support to the lower circular flange 545 and enhancing the structural rigidity of the syringe piston 540. An elongate, upstanding pressure relief post 552 can be disposed near the rim of the bowl 541 with a portion thereof protruding upwardly past the top edge of the upper circular flange 544. This pressure relief post 552 serves as an actuator for the pressure relief valve 570, the details of which will be described below.

The syringe piston 540 also includes means for recirculating liquid and/or gas back into the reaction vessel 530 and thereby the container 512 during operation. This serves as another means of alleviating or stabilizing excess pressure in the overall system as can be included as a part of the pressure relief system. As shown, the piston rod 542 is provided with a hollow stem 542*a* in communication with at least a pair of inlet vents or passages 542*b*. In this exemplary embodiment, the hollow stem 542*a* is an elongate, stepped blind bore formed inside and extending substantially the length of the piston rod 542. The lower, open end of the hollow stem 542*a* tapers outwardly into a mounting recess 546*b* of a one-way valve boss 546. A one-way valve 546*a* is mounted in the mounting recess 546*b*. The one-way valve 546*a* can be one of a variety of valve configurations such as an umbrella valve, check valve, duck bill valve, and the like. A side vent channel 546*e* extends radially from the interior of the mounting recess 546*b* to the outer surface of the syringe piston 540. As best seen FIGS. 15B and 16B, the side vent channel 546*c* desirably extends near the juncture between the bowl 541 and the lower circular flange 545.

The piston rod 542 includes a pair of spaced annular grooves 543*a*, 543*b* where a corresponding one of shaft O-rings 513*a*, 513*b* can be mounted to provide an airtight and watertight seal in the bore 527 during reciprocation of the syringe piston 540. The inlet vents 542*b* extend radially towards the outer surface of the rod 542, and each open end of the inlet vents 542*b* is disposed between the annular grooves 543*a*, 543*b*. The bore 527 includes openings 526*a* within the path of reciprocation of the syringe piston 540 such that during select reciprocation of the syringe piston 540, the inlet vents 542*b* are exposed to the bore openings 526*a* at select reciprocated position. This allows flow of gas or fluid through the inlet vents 542*b*, down through the one-way valve 546*a*. The one-way valve 546*a* permits the gas or fluid to flow from inside the syringe piston 540 back into the container 512. As best seen in FIG. 16B, the gas or fluid flowing through the one-way valve 546*a* escapes through the side vent channel 546*c* into the space 546*d* above the lower circular flange 545. Instead of being trapped therein, the gas or fluid can flow back into the container 512 due to the discontinuities 533 on the threads 532 of the reaction vessel 530. During this operation, the O-rings 513*a*, 513*b* function as a selectively operable valve due to the opening of the inlet vents 542*b* being disposed between the O-rings 513*a*, 513*b*, and the O-rings 513*a*, 513*b* selectively opening and closing communication with the corresponding openings 526*a* in the bore 527.

An annular collar 551 fits around the central column 526 providing structural reinforcement for the central column 526. This type of reinforcement counters potential instances of deformation or expansion of the central column 526 due to excess pressure buildup, which can potentially compromise the functionality of the syringe piston 540 and the selective valve action of the seals 513*a*, 513*b*. The annular collar 551 also includes a pair of opposing vent grooves 551*a* (FIG. 13) inside the collar 551 that define pathways for introduction of gas or liquid through the central column 526 into the inlet vents 542*b*.

Figure 15A:
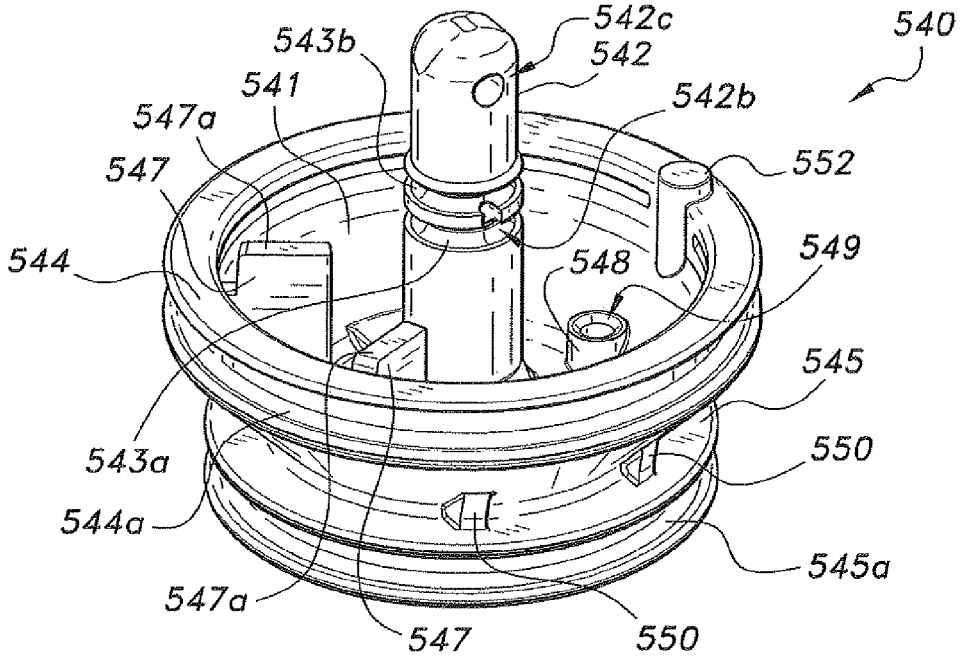
FIG. 15A is a top perspective of the syringe piston in the carbonation device shown in FIG. 12.
Figure 15B:
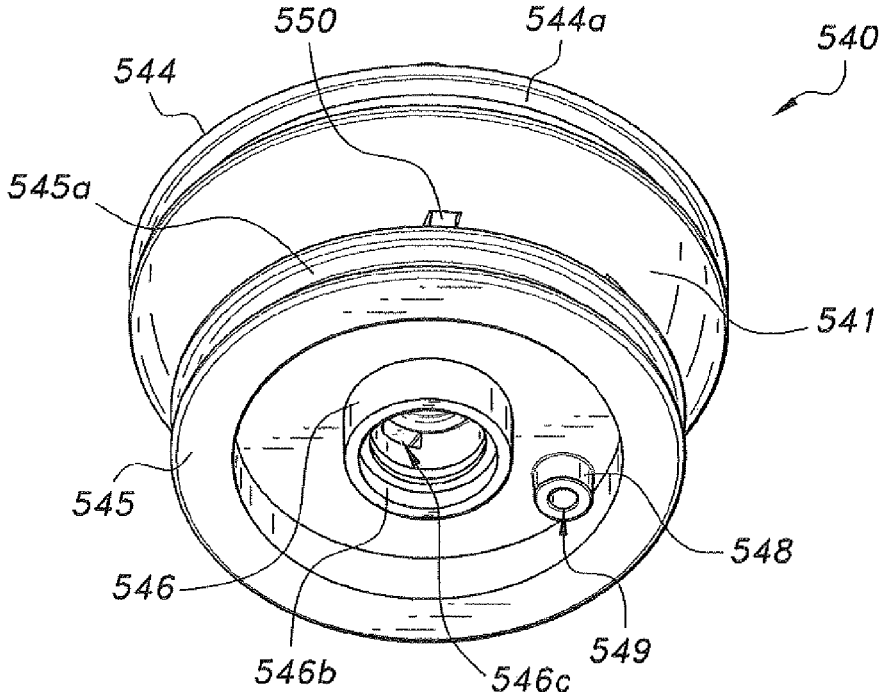
FIG. 15B is a bottom perspective view of the syringe piston in the carbonation device shown in FIG. 12.

As best shown in FIG. 15A, the interior of the bowl 541 includes a pair of angularly spaced fins, ribs or walls 547 extending therefrom. These fins 547 reinforce the walls of the bowl 541 and thereby maintain the shape of the bowl or cup 541. The bottom of the syringe piston 540 is provided with a downwardly extending post or bushing 548 having a through bore or port 549. The port 549 permits transfer of fluid or gas between the reaction vessel 530 and the bowl 541. The bushing 548 extends upwardly into the interior of the bowl 541 to a predefined height, this height being less than the height of the bowl 541. During operation where the cap 520 and the syringe piston 540 connected thereto have been turned upside down for filling with a reactant liquid, such as water, the interior extension of the bushing 548 facilitates trapping a quantity of air inside the syringe piston 540. The amount of trapped air depends on the surface geometry of the interior ceiling portion of the cap 520 when upright. When the carbonation device 500 is placed upright, the trapped air collects between the ceiling and the bowl 541. The trapped air serves as a buffer that substantially prevents the reactant liquid, such as water, from prematurely escaping through exhaust pathways to accidentally squirt the user. Such accidental incidents can occur when a small amount of reactant liquid, such as water, inadvertently trickles into the reaction vessel 530 from the syringe piston 540 and prematurely starts the effervescent reaction. Without the buffer, the pressure from the premature reaction could cause the reactant liquid, such as water, inside the piston 540 to escape, and the interior extension of the bushing 548 helps to prevent such an occurrence.

As best shown in FIGS. 13 and 16A-16C, the syringe piston 540 is provided with a deflector shield 554 configured to be mounted on top of the syringe piston 540. The deflector shield 554 includes a pass-through opening 554*a* shaped to allow the deflector shield 554 to slide over the piston rod 542 during assembly and over the annular collar 551 during operation. A mounting means, such as a depending mounting flange 554*c*, facilitates detachable mounting of the deflector shield 554 onto the syringe piston 540. Also, the deflector shield 554 can be fixed thereon, for example.

In order to insure that the deflector shield remains in place after assembly, the pass-through opening 554*a* includes an arcuate segment 554*d* and a notch 554*b* at the periphery of the deflector shield 554. When assembled, upwardly projecting tabs 547*a* on the fins 547 engage or substantially engage the lateral ends of the arcuate segment 554*d*, securing and stabilizing the deflector shield 554 on top of the bowl 541. At the same time, the notch 554*b* engages or substantially engages a side of the pressure relief post 552 for similar function. Thus, the notch 554*b* is desirably shaped to conform to the shape of the pressure relief post 552. By this construction, the deflector shield 554 is secured in place in at least two different locations which prevents the deflector shield 554 from inadvertently rotating on top of the bowl 541.

The deflector shield 554 serves to block as much of the reaction slurry from escaping into the container 512 as possible and insures that only $CO_2$ flows into the beverage during the carbonation process. As is evident from the operation of the carbonation device 10, the carbonation device 500 is also selectively shaken to propagate the carbonation process. Such actions can result in unwanted reaction slurry being introduced into the beverage. The deflector shield 554 minimizes such occurrences by functioning as a plate within a reflux distillation process that helps separate high volatiles from the low volatiles. In this instance, the carbonating gas is treated as an analog of a high volatile and the reaction slurry is treated as an analog of a low volatile. The carbonation device 500 can be provided with a plurality of deflector shields—stacked or strategically placed at select locations in the exhaust pathway, etc.—to increase the reflux and distillation effect, thereby minimizing slurry potentially and undesirably being introduced into the beverage.

As best shown in the above drawings, the interior rim portion of the reaction vessel 530 is tapered outward forming a frustoconical shaped opening. The syringe piston 540 also has an overall frustoconical shape between the upper flange 544 and the lower flange 545 that fits snugly over the top of the reaction vessel 530 when assembled. When the syringe piston 540 is plunged downward during operation to the lowermost point of travel, the syringe piston 540 seals against the open end of the reaction vessel 530 and closes the reaction vessel 530 off from the beverage container 512, thereby stopping the flow of $CO_2$ gas into the beverage. The seal of the reaction vessel 530 is facilitated by the lower piston O-ring 518 engaging the inner wall of the reaction vessel 530 below the taper thereof. The upper piston O-ring 517 provides a seal above the rim of the reaction vessel 530 by engaging the interior of the annular wall 524, but the seal of the upper piston O-ring 517 is for sealing the space 546*d* between the upper circular flange 544 and the lower circular flange 545 thereby forming a chamber through which excess gas or fluid can flow through the hollow stem 542*a*, past the one-way valve 546*a*, through the side vent channel 546*c*, and back into the container 512 via the discontinuities 533 as described above.

The reaction vessel 530 also includes a plurality of pressure relief notches 536, as a part of the pressure relief system, angularly spaced around the interior surface of the reaction vessel 530. The pressure relief notches 536 have been configured so that they are disposed above the lower piston O-ring 518 when the syringe piston 540 is in the lowermost position of reciprocation. When the syringe piston 540 is selectively raised during the carbonation process or to manually relieve pressure, the lower piston O-ring 518 rises above the pressure relief notches 536. This action provides openings that permit the pressurized gas to circulate within the overall system in a less constricted manner, especially during selective, manual depressurizing of the carbonation device 500 via the manual pressure relief valve 570. Additionally, the pressure relief notches 536 provide a more gradual and thereby controlled pressure dispersion by presenting an initial opening for release of pressure rather than an abrupt depletion that normally occurs from a reaction vessel without such pressure relief notches. In the exemplary embodiment, the pressure relief notches 536 are constructed as shallow depressions or recesses within the interior wall of the reaction vessel 530. These pressure relief notches 536 can be provided by a variety of different shaped recesses or even small orifices that extend out to the threads 532.

Figure 12:
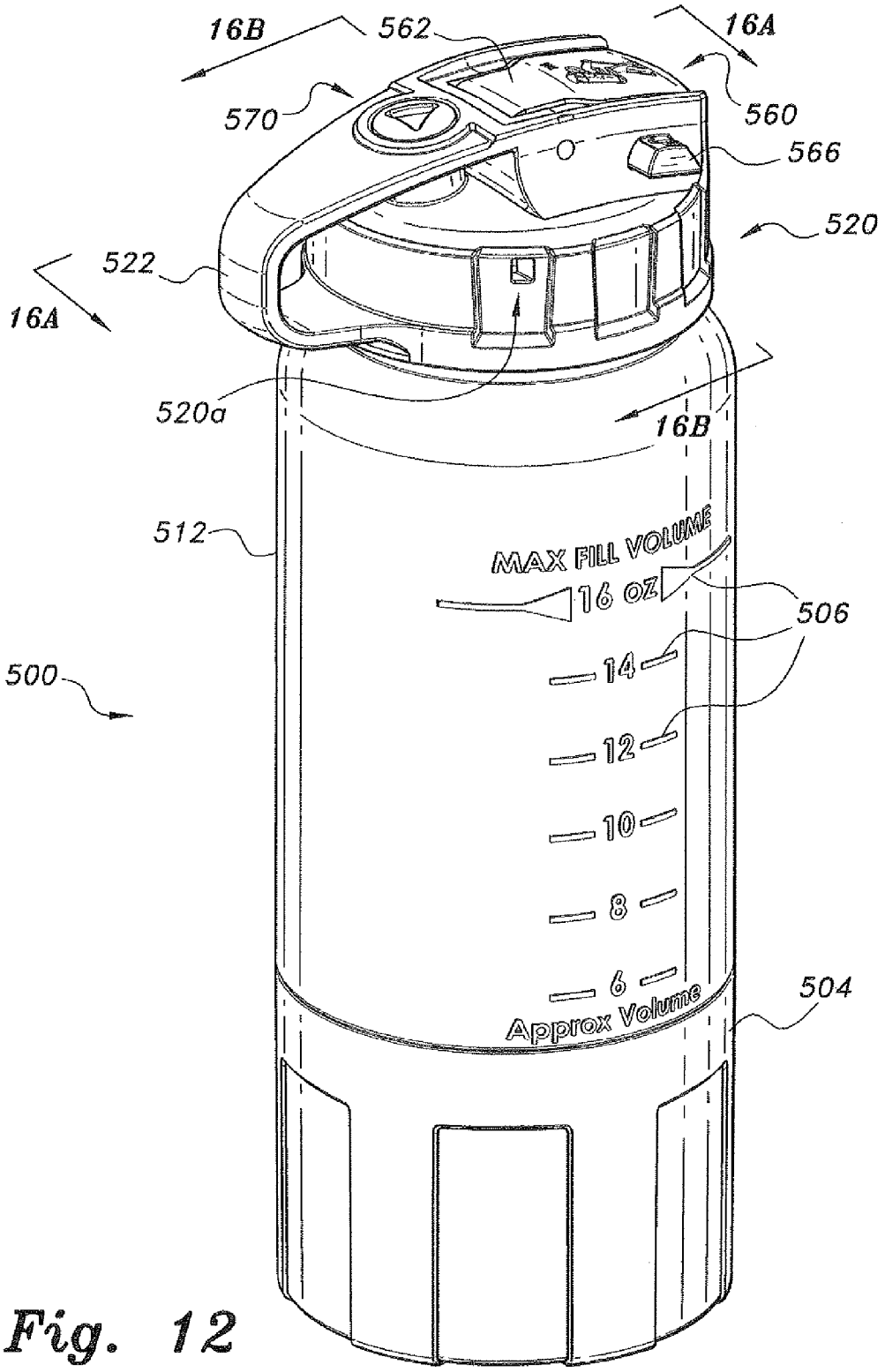
FIG. 12 is an environmental perspective view of yet another embodiment of a carbonation device according to the present invention.
Figure 16A:
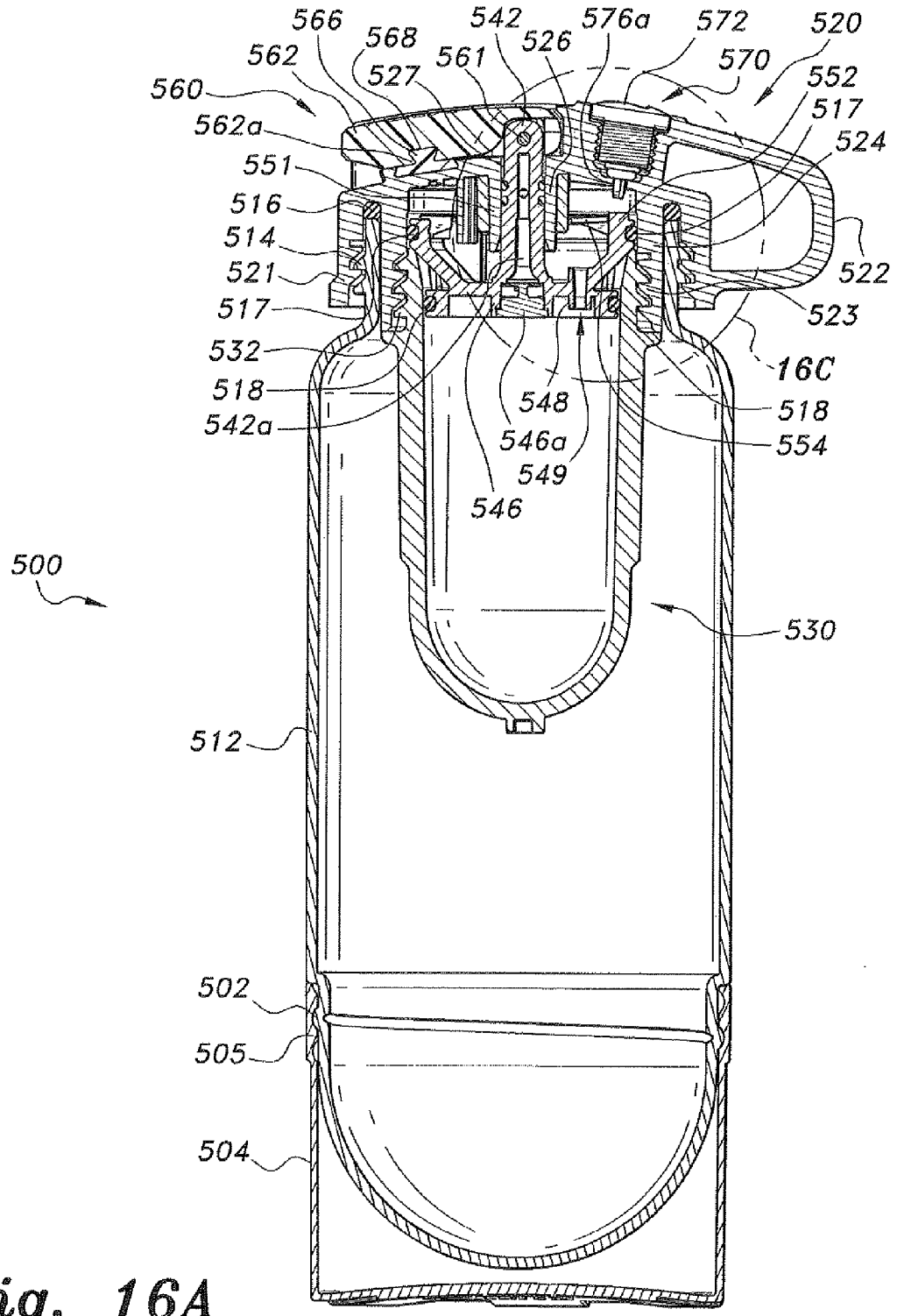
FIG. 16A is an elevation view in section taken along section 16A of FIG. 12 of the carbonation device shown in FIG. 12.
Figure 16B:
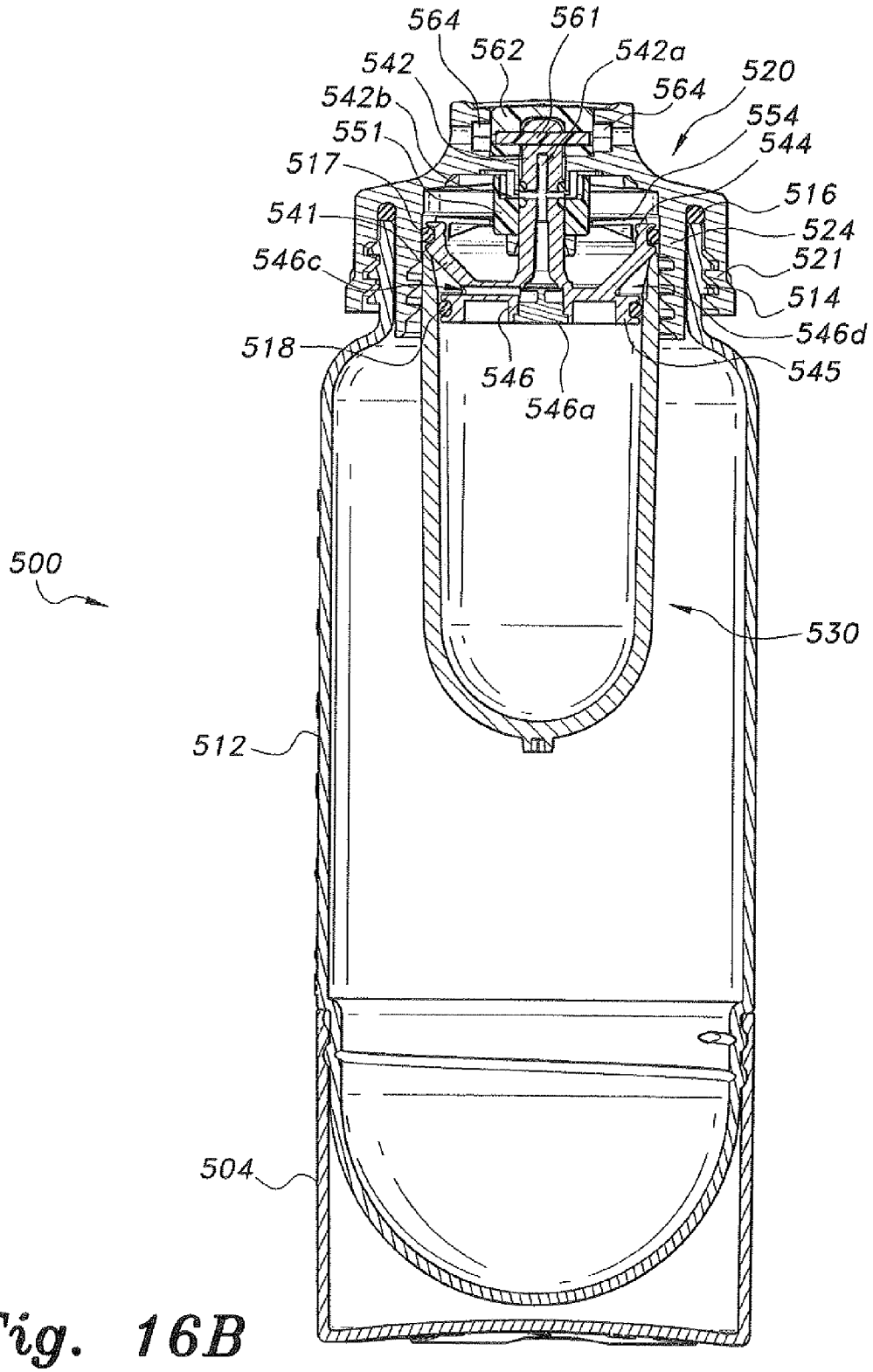
FIG. 16B is an elevation view in section taken along section 16B of FIG. 12 of the carbonation device shown in FIG. 12 perpendicular to the cut plane in FIG. 16A.

The operation of the syringe piston 540 is provided by an actuating mechanism 560 best seen in FIGS. 12, 13 and 16A. The actuating mechanism 560 can include a cam lever 562 disposed within the recess 526*b* on top of the cap 520. The lever 562 is pivotally connected to the piston rod 542 via a pin, bar or rod 561. The pin 561 is threaded through corresponding bores 563 on the lever 562 and a pivot bore 542*e* on the piston rod 542. The lever 562 includes at least one follower 564 adjacent the bore 563. The follower(s) 564 rides in corresponding cam channels, grooves or slots 528 disposed within the recess 526*b*. The follower(s) 564 also defines the pivot axis of the lever 562. Selective operation of the lever 562 up or down results in corresponding raising or lowering motion of the syringe piston 540. Since the central bore 527 limits the shaft movement vertically, the action of the follower(s) 564 and cam channels 528 ensure that movement of the pivotal connection between the lever 562 and the shaft 542 is also limited vertically due to the pivot axis being variable during the operation of the lever 562. Although the above exemplary embodiment is desirable, other mechanical mechanisms that provide mechanical advantage for moving the syringe piston 540, such as a four-bar linkage or a threaded rotational actuating cap, can also be used.

The actuating mechanism 560 can also include a locking assembly for keeping the lever in the inoperative or down position, especially for transport. Another main aspect for the locked position is that the locked position seals the syringe piston 540 against the top of the reaction vessel 530 whenever needed, i.e., the locked position closes the valve. The locking assembly includes a slidable locking bar, rod or beam 566 received in correspondingly spaced mounting slots 567 formed in the recess walls of the recess 526*b*. The locking bar 566 can be an elongate beam having a substantially trapezoidal shape in cross section. A central rib 562*a* on the bottom of the lever 562 includes a locking slot 568 corresponding to the cross-sectional shape of the locking bar 566 to form a dovetail join when the locking bar 566 is in the locked position. To release the lock, the user slides the locking bar 566 until an unobstructed zone 569 mates with the locking slot 568, where the dovetail join cannot form. In this position, the lever 562 is free to move. Other locking mechanisms, such as latches or spring locks, can also be employed, for example.

During operation of the carbonation device 500, the interior pressure can at times require release in addition to the passive and active means described above. In that regard, the carbonation device 500 includes, as a part of the pressure relief system, a manual pressure relief valve 570 disposed on top of the cap 520 in a recess 571 adjacent the actuating mechanism 560. The pressure relief valve 570 includes a valve stem 576 covering a relief hole or bore 529. The valve stem 576 is held in place by the combined action of a biasing means, such as a spring 574 and a nut 572 threaded into the recess 571. The spring 574 holds the valve stem 576 against the bore 529, and a seal ring 577 is disposed between the valve stem 576 and the bore 529 to substantially prevent undesirable leaks. Also, various springs, such as a clip spring or an elastomeric sleeve, can be used for the relief valve 570, for example.

The valve stem 576 also includes an elongate post 576*a* extending down past the bore 529 to be disposed a select or predefined distance above and in line with the pressure relief post 552. The elongate post 576*a* is selectively acted on by the pressure relief post 552 in order to manually move the valve stem 576 up within the bore 529, thereby unsealing the bore 529 allowing the pressure and gas to vent.

Figure 16C:
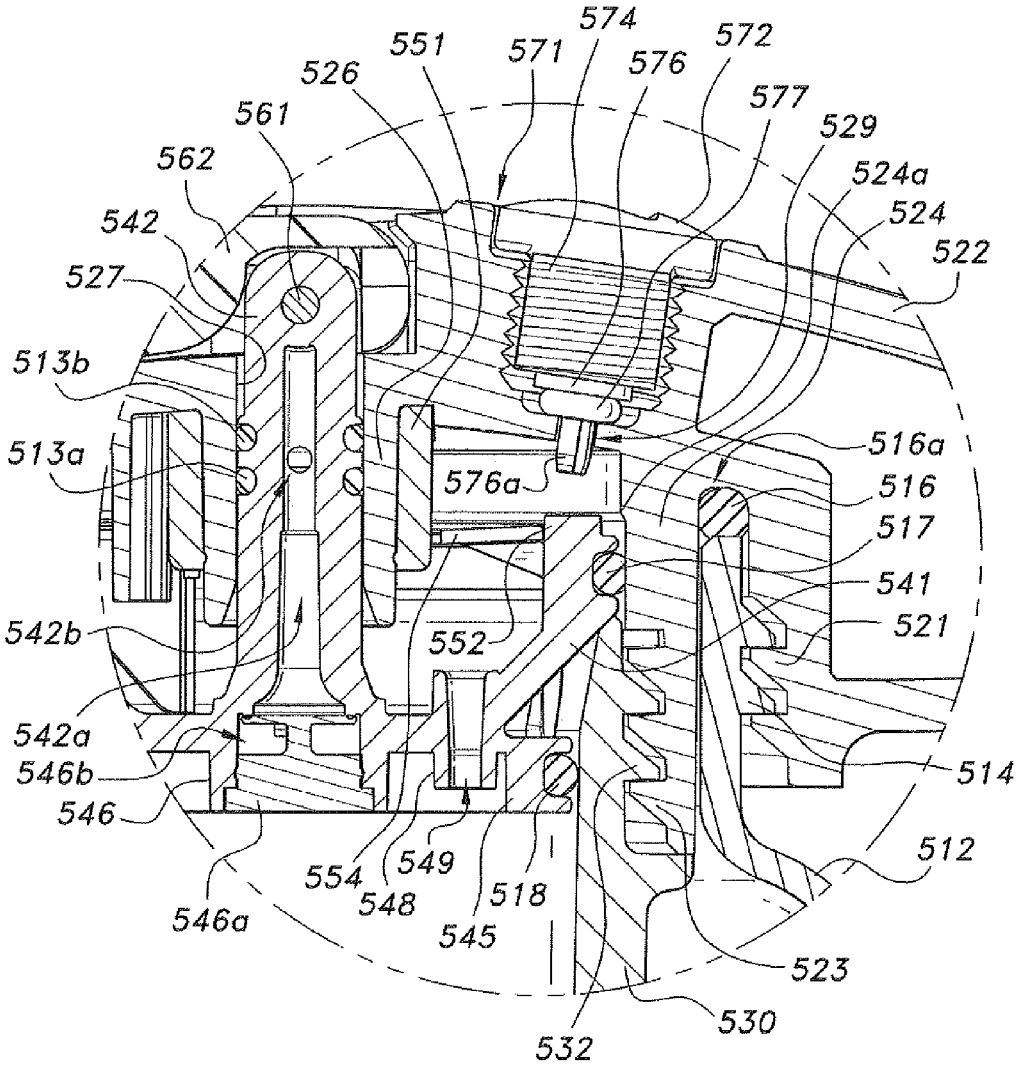
FIG. 16C is a partial elevation view in section of the carbonation device shown in FIG. 12.

The above manual pressure relief is facilitated by user operation of the lever 562. As best shown in FIG. 16C, the interior of the annular wall 524 includes a constriction ledge 524*a* near the top of the annular wall 524 adjacent the valve stem 576. This constriction ledge 524*a* has an inner diameter smaller than the inner diameter of the annular wall 524. Normal operation of the lever 562 usually maintains reciprocation of the syringe piston 540 between the constriction ledge 524*a* and the lowermost point of travel for the syringe piston 540, and the constriction ledge 524*a* provides feedback to the user via a "bump" sensation when the syringe piston 540 or the upper piston O-ring 517 encounters the constriction ledge 524*a* during the course of travel. The feedback alerts the user that an upper limit of travel of the syringe piston 540 has been reached for normal operation. However, when the user desires to manually relieve pressure, the user can pivot the lever 562 further, e.g., clockwise in the orientation shown in FIG. 16C, forcing the syringe piston 540 to rise past the constriction ledge 524*a* towards the ceiling of the interior of the cap 520. This action forces the pressure relief post 552 on the syringe piston 540 to engage the elongate post 576*a* of the valve stem 576, and upon further raising of the syringe piston 540, the pressure relief post 552 pushes the valve stem 576 upwardly against the bias of the spring 574 to unseal the pressure relief bore 529.

The following describes how to use the carbonation device 500. When a user desires to carbonate a beverage, the cap 520 is removed from the container 512 to remove the reaction vessel 530. The container 512 is filled with some reactant liquid, such as water, and the cap 520 replaced. The container 512 is turned upside down so that the reactant liquid, such as water, pools toward the cap 520. The lever 562 is then unlocked and pivoted up and down repeatedly to reciprocate the syringe piston 540. The reciprocation of the syringe piston 540 creates a vacuum that pulls the reactant liquid, such as water, into the cup or bowl 541 through the port 549. The cup or bowl 541 is filled to the desired or predefined limit, such as when substantially no more air bubbles escape through the port 549.

Once filled with a reactant liquid, such as water, the reaction vessel 530 is filled with a predetermined amount of carbonating reactants and mounted to the cap 520. The container 512 is then filled with the beverage to be carbonated, and the cap 520 is reattached. In the upright position, the lever 562 is cycled several times to dispense the reactant liquid, such as water, through the port 549. The reactant liquid, such as water, contacts the effervescent reactants within the reaction vessel 530 and triggers the start of the chemical reaction. After a short period of time, the lever 562 is placed in the up position to open the top of the reaction vessel 530, which permits flow of the carbonating gas from the reaction vessel 530 into the liquid, such as a fluid or a beverage. It is noted that during this operation, the configuration of the syringe piston 540 and the limited travel facilitated by the piston rod 542 allows for only a fraction of the water to be dispensed into the reaction vessel 530 at a time. While it is possible to empty the full contents of the syringe piston 540 at one time with corresponding modifications of the syringe piston 540 and the reaction vessel 530, such a configuration can cause a difficult to control reaction with the carbonating reactants, i.e., the reaction and pressure buildup can be too rapid. To help prevent this type of occurrence, the carbonation production is staggered by using discreet amounts of a reactant liquid, such as water, per cycle until all the reactant liquid, such as water, has been consumed. Thus, carbonation occurs over a relatively longer period of time for a relatively more even and efficient consumption and absorption of the gas into the liquid, such as a fluid or a beverage.

Additionally, the pressure relief notches 536 inside the reaction vessel 530 ease circulation of the pressurized gas when the syringe piston 540 is raised. This allows for better controlled effervescent processing. If the internal pressure is too great, the user can raise the syringe piston 540 further in order to operate the manual pressure relief valve 570 as described above. Furthermore, the flow of gas is not limited to just the reaction vessel 530 and the container 512. The gas can also flow back into the syringe piston 540 through the port 549. From there, the gas can flow through the inlet vents 542*b* down the hollow stem 542*a* and through the one-way valve 546*a* to be circulated back into the beverage to be carbonated.

As naturally occurs, the gas production reaches equilibrium where carbonation is at a minimum. At this point, the user operates the lever 562 into the down position, closing the reaction vessel 530. The user then locks the lever 562 and shakes the carbonation device 500 vigorously for a short time. This agitation can serve two purposes, for example. The first purpose can result in increased production of carbonating gas by increasing the reaction between the reactants. The second purpose can result in forcing the remaining gas in the container 512 to be absorbed into the liquid, such as a fluid or a beverage, due to the liquid moving inside the container 512. Both can result in optimizing carbonation of the liquid, such as a fluid or a beverage.

When the newly generated $CO_2$ reaches a desired pressure level, the lever 562 can be raised to the up position to thereby open the top of the reaction vessel 530 and allow the gas to escape into the liquid, such as a fluid or a beverage. The above is repeated until the liquid, such as a fluid or a beverage, has been carbonated to the user's satisfaction.

It is to be understood that the carbonation devices 10, 100, 200, 400, 500 can encompass a wide variety of embodiments. For example, the carbonation devices 10, 100, 200, 500 are desirably made from durable plastic, but other materials, such as aluminum, steel, composites, wood or any combination thereof, can also be used. In addition, threading and other components can be sized to fit a variety of bottles and containers. Moreover, with respect to the carbonation device 200, the locations, shape and size of the various ports and vents in the cap 220 and the control grooves in the control ring 240 can be rearranged, so long as they can be aligned to form pathways for the water and carbonating gas. In various embodiments, the lance 300 can be incorporated into the carbonation devices 10, 100 in a similar manner as that shown in the carbonation device 400. Furthermore, the carbonation devices 10, 100, 200, 400, 500 can include a variety of colors and indicia for aesthetic appeal, advertising, personal messaging or indicators of various components.

In still further embodiments to the above, a different kind of valve system can be used to collect and transfer a reactant liquid, such as water, to a reaction vessel. For example, a rotatable trough can be used to collect a preselected amount of reactant liquid, such as water, in one position, and in another rotated position, dumps the reactant liquid, such as water, to a reaction vessel. Moreover, with respect to the carbonation device 200, the locations, shape and size of the various ports and vents in the cap 220 and the control grooves in the control ring 240 can be rearranged, so long as they can be aligned to form pathways for a liquid, such as water, and carbonating gas.

It is to be understood that the present invention is not limited to the embodiments described above, but encompasses any and all embodiments within the scope of the following claims.

I claim:

1. A carbonation device, comprising:

a substantially hollow cap adapted to be mounted to an opening of a liquid container;

a reciprocating syringe piston slidably mounted on the cap, the syringe piston having a bowl to hold and dispense a reactant liquid;

an actuating mechanism mounted on the cap to selectively reciprocate the syringe piston;

a reaction vessel mounted on the cap, the reaction vessel being adapted to hold at least one carbonating gas producing reactant to be mixed with the reactant liquid from the bowl;

a carbonating gas distribution system connected to the cap, the carbonating gas distribution system to dispense a carbonating gas into a liquid held in the liquid container; and a pressure relief system to passively and selectively relieve pressure within the carbonating gas distribution system, wherein operation of the actuating mechanism creates a vacuum to draw the reactant liquid into the bowl, the reactant liquid being dispensed into the reaction vessel to be mixed with the at least one reactant to produce the carbonating gas to carbonate a liquid inside the liquid container.

2. The carbonation device according to claim 1, wherein the cap includes a handle loop.

3. The carbonation device according claim 1, wherein said cap comprises:

first internal threads for mounting the cap onto the liquid container, the first internal threads having a diameter;

an annular wall within said cap, said annular wall having second internal threads concentric with the first internal threads, the second internal threads mounting said reaction vessel, the second internal threads having a diameter smaller than the first internal threads diameter; and an annular space defined between the first internal threads and the annular wall, the annular space accommodating a neck portion of said liquid container for mounting on the cap.

4. The carbonation device according to claim 3, wherein said pressure relief system comprises:

an annular trough formed at an upper end of said annular space;

a first O-ring disposed within the annular trough; and at least one seal pressure relief vent formed on said cap, the at least one seal pressure relief vent extending into said annular trough to be in communication therewith, the first O-ring normally covering the at least one seal pressure relief vent, wherein during uncapping of said cap, a presence of excessive pressure deforms or moves the first O-ring to uncover the at least one seal pressure relief vent in order to permit venting of the excess pressure.

5. The carbonation device according to claim 4, wherein said annular trough comprises an extended profile, in cross section, different from a cross-sectional shape of said first O-ring, the extended profile providing a space to direct pressurized carbonating gas from excess pressure, when present, in order to deform or move said first O-ring and uncover said at least one seal pressure relief vent to release the excess pressure through the at least one seal pressure relief vent.

6. The carbonation device according to claim 4, wherein said pressure relief system further comprises at least one container vent formed around an inner diameter of said neck portion of said liquid container, the at least one container vent permitting flow of gas between said neck portion and said annular wall.

7. The carbonation device according to claim 6, wherein said at least one container vent comprises a plurality of angularly spaced depressions disposed around said inner diameter of said neck portion.

8. The carbonation device according to claim 3, wherein said syringe piston comprises:

an elongate, upwardly extending piston rod centrally disposed in said bowl, the piston rod having a pivot pin pivotally connected to said actuating mechanism;

a vent post formed at the bottom of said bowl, the vent post having a throughbore to permit flow of the reactant liquid or gas into and out of said bowl, the vent post extending into said bowl to a height below a top of said bowl;

an upper circular flange extending from the top of said bowl, the upper circular flange having an annular groove formed thereon;

an upper O-ring disposed in the annular groove of the upper circular flange, the upper O-ring having a diameter;

a lower circular flange extending from a bottom of said bowl, the lower circular flange having an annular groove formed thereon; and a lower O-ring disposed in the annular groove of the lower circular flange, the lower O-ring having a diameter smaller than the diameter of the upper O-ring, the upper O-ring and the lower O-ring selectively opening and sealing passage of the carbonating gas from said reaction vessel upon raising or lowering of said syringe piston respectively.

9. The carbonation device according to claim 8, wherein said pressure relief system comprises:

an elongate central column formed inside said cap, the central column having a throughbore for slidably receiving said piston rod, the central column having at least one passage for circulating gas or liquid;

an annular collar mounted to the central column, the annular collar having at least one vent groove formed inside the annular collar, the at least one vent groove being in communication with the at least one passage on the central column, the at least one vent groove and the at least one passage forming a pathway for circulating gas or liquid;

an elongate hollow stem formed inside said piston rod, the hollow stem having an open end near the bottom of said bowl;

a substantially hollow boss extending downwardly from the bottom of said bowl, the boss being in communication with the open end of the hollow stem, the boss having a mounting recess;

at least one side vent channel extending from the mounting recess to outside said bowl;

a one-way valve mounted inside the mounting recess, the one-way valve being in communication with said reaction vessel, the one-way valve to permit flow of gas or liquid into said liquid container through said at least one side vent channel;

at least one inlet vent extending from the hollow stem to an outer surface of said piston rod, the at least one inlet vent adapted to be in communication with the at least one passage of the central column at an at least one predefined reciprocated position of said piston rod of the syringe piston;

at least one pair of annular grooves formed on said piston rod, one of the pair of annular grooves respectively disposed above the at least one inlet vent and the other of the pair of annular grooves respectively disposed below the at least one inlet vent; and at least one pair of O-rings each mounted to a respective annular groove on said piston rod, the at least one pair of O-rings forming a seal within the throughbore of the central column above and below a corresponding at least one inlet vent, the pair of O-rings selectively opening communication with the at least one passage of the central column to allow gas or liquid to flow into the hollow stem and out of the one-way valve at the at least one predefined reciprocated position of said piston rod and closing the communication in at least one another reciprocated position of said piston rod, the selective opening of communication to permit excess pressure to equalize within said carbonating gas distribution system.

10. The carbonation device according to claim 9, wherein the syringe piston further comprises a plurality of reinforcing ribs in said bowl for maintaining a shape of said bowl.

11. The carbonation device according to claim 10, wherein said cap has a recess defined therein, and said actuating mechanism comprising:

a cam lever mounted in the recess in said cap, the cam lever having a portion thereof pivotally attached to said syringe piston;

at least one follower disposed on one end of the cam lever; and a cam channel formed in the recess in said cap, wherein raising and lowering of the cam lever reciprocates said syringe piston.

12. The carbonation device according to claim 11, further comprising a locking mechanism for locking the cam lever in a lowered position.

13. The carbonation device according to claim 12, wherein the locking mechanism comprises:

an elongate locking bar extending substantially perpendicular to said cam lever, said locking bar having a cross-sectional shape and a discontinuous section;

a pair of spaced mounting slots formed in said recess on said cap, said mounting slots having a shape corresponding to the cross-sectional shape of said locking bar; and a central rib on said cam lever, the central rib having a slot, the slot having a shape corresponding to the cross-sectional shape of said locking bar, wherein said locking bar is slidable in said mounting slots to a locked position where the cross-sectional shape of the locking bar mates with the shape of the slot in said central rib, forming a locking joint, and is slidable to an unlocked position where said discontinuous section mates with the slot in said central rib.

14. The carbonation device according to claim 11, wherein said pressure relief system further comprises:

a pressure relief valve disposed on top of said cap;

a pressure relief post extending upwardly from said bowl of said syringe piston, the pressure relief post having a height greater than the top of said bowl, the pressure relief post selectively actuating the pressure relief valve; and an annular constriction ledge formed inside said annular wall, the annular constriction ledge having an inner diameter smaller than the diameter of a major portion of said annular wall.

15. The carbonation device according to claim 14, wherein said pressure relief valve comprises:

a valve stem received in a recess on said cap, the valve stem covering a vent hole, the valve stem having an elongate post extending into the inside of said cap, the elongate post being disposed substantially in line and above said pressure relief post;

a seal ring sealing the valve stem from the vent hole;

an elongated spring biasing the valve stem against the vent hole at one end; and a nut disposed against the other end of the spring;

wherein selective raising of said syringe piston past said annular constriction ledge forces said pressure relief post to engage and push the elongate post of the valve stem to manually open the vent hole to relieve excess pressure.

16. The carbonation device according to claim 14, further comprising:

at least one deflector shield selectively mounted on top of said bowl, the at least one deflector shield minimizing introduction of a reaction slurry into the liquid in the liquid container, the at least one deflector shield having a pass-through opening shaped to allow the at least one deflector shield to slide over said piston rod and said annular collar;

a mounting flange depending from one side of the at least one deflector shield to securely mount the at least one deflector shield onto the syringe piston; and a notch formed at a periphery of the at least one deflector shield, the notch shaped to conform to and engage a side of said pressure relief post.

17. The carbonation device according to claim 16, wherein:

said reinforcing ribs include upwardly extending tabs, and said pass-through opening comprises an arcuate segment having lateral ends, the lateral ends engaging the tabs of the reinforcing ribs when assembled, the engagement of the tabs and said notch substantially preventing unwanted rotational movement of the at least one deflector shield.

18. The carbonation device according to claim 8, wherein said pressure relief system further comprises at least one pressure relief notch formed on an inner surface of said reaction vessel, the at least one pressure relief notch positioned to be selectively revealed when said lower O-ring is raised from a lowermost position thereof.

19. The carbonation device according to claim 1, further comprising a boot detachably mounted to said liquid container.

* * * * *